US007252722B2

(12) United States Patent
Nakajima et al.

(10) Patent No.: US 7,252,722 B2
(45) Date of Patent: Aug. 7, 2007

(54) STEEL SHEET

(75) Inventors: Katsumi Nakajima, Fukuyama (JP); Takeshi Fujita, Fukuyama (JP); Toshiaki Urabe, Fukuyama (JP); Yuji Yamasaki, Fukuyama (JP); Fusato Kitano, Fukuyama (JP)

(73) Assignee: NKK Corporation, Tokyo (JP)

( * ) Notice: Subject to any disclaimer, the term of this patent is extended or adjusted under 35 U.S.C. 154(b) by 419 days.

(21) Appl. No.: 10/792,546

(22) Filed: Mar. 2, 2004

(65) Prior Publication Data

US 2004/0168753 A1 Sep. 2, 2004

Related U.S. Application Data

(62) Division of application No. 10/043,903, filed as application No. PCT/JP01/05209 on Jun. 19, 2001, now Pat. No. 6,743,306.

(30) Foreign Application Priority Data

| | | |
|---|---|---|
| Jun. 20, 2000 | (JP) | 2000-183870 |
| Jun. 20, 2000 | (JP) | 2000-183871 |
| Jun. 29, 2000 | (JP) | 2000-195437 |
| Jun. 29, 2000 | (JP) | 2000-195438 |
| Jun. 30, 2000 | (JP) | 2000-198652 |

(51) Int. Cl.
*C22C 38/12* (2006.01)
*C22C 38/26* (2006.01)
*C22C 38/48* (2006.01)

(52) U.S. Cl. ..... 148/320; 148/332; 148/334; 148/335; 148/336; 428/659

(58) Field of Classification Search ..... 148/320, 148/332–336; 428/659
See application file for complete search history.

(56) References Cited

U.S. PATENT DOCUMENTS

| | | | |
|---|---|---|---|
| 4,857,117 | A | 8/1989 | Sakata et al. |
| 5,360,493 | A | 11/1994 | Matsuoka et al. |
| 6,171,412 | B1 | 1/2001 | Matsuoka et al. |

FOREIGN PATENT DOCUMENTS

| | | | |
|---|---|---|---|
| JP | 61-32375 | B2 | 7/1986 |
| JP | 2-175837 | A | 7/1990 |
| JP | 3-277741 | * | 12/1991 |
| JP | 5-59489 | A | 3/1993 |
| JP | 5-70836 | A | 3/1993 |
| JP | 5-78784 | A | 3/1993 |

(Continued)

*Primary Examiner*—Deborah Yee
(74) *Attorney, Agent, or Firm*—Frishauf, Holtz, Goodman & Chick, P.C.

(57) ABSTRACT

A steel sheet containing 0.004 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, by mass %, optionally Ti, Bi or at least one element selected from the group consisting of Cr Mo, Ni and Cu, and the balance being Fe; the Nb content satisfying a formula of $$(12/93)\times Nb^*/C \geqq 1.0,$$

wherein $Nb^*=Nb-(93/14)\times N$, and wherein C, N and Nb designate the content in mass % of carbon, nitrogen and niobium, respectively; and a yield strength and an average grain size of the ferritic grains which satisfy a formula of $$YP \leqq -120\times d+1280,$$

wherein YP designates yield strength in MPa, and d designates an average size of ferritic grains in μm.

18 Claims, 15 Drawing Sheets

FOREIGN PATENT DOCUMENTS

| | | | |
|---|---|---|---|
| JP | 5-112845 | A | 5/1993 |
| JP | 6-158162 | A | 6/1994 |
| JP | 7-47796 | B2 | 5/1995 |
| JP | 7-62209 | B2 | 7/1995 |
| JP | 8-92656 | A | 4/1996 |
| JP | 8-143969 | A | 6/1996 |
| JP | 9-263903 | A | 10/1997 |
| JP | 10-280092 | A | 10/1998 |

* cited by examiner

STEEL SHEET

CROSS-REFERENCE TO RELATED APPLICATIONS

This application is a divisional application of application Ser. No. 10/043,903 filed Jan. 11, 2002 (U.S. Pat. No. 6,743,306), issued Jun. 1, 2004 which is a continuation application of International Application PCT/JP01/05209 filed Jun. 19, 2001.

FIELD OF THE INVENTION

The present invention relates to a steel sheet used in automobiles, household electric appliances, building materials, and the like, and to a method for manufacturing the same.

BACKGROUND OF THE INVENTION

Industrial fields of automobiles and household electric appliances request for the reduction of production cost and the increase in productivity. Particularly in a press-forming process, the productivity increase has been promoted through the shortening of cycle time by speed increase and the extension of operation time. In that high level productivity, since the temperature increase in mold induces variations of press-forming conditions, there appear problems of generation of cracks and wrinkles, thus increasing in press-rejection rate.

As for the steel sheets for automobiles, occupied by press-forming steel sheets, there has been increasing the requirement to satisfy both the strength increase of steel sheets for improving safety and the work-saving in press-forming process including the reduction in the number of parts through integration of parts. To respond to the request, the steel sheets for press-forming are also required to have sufficient allowance in press-forming as well as the high formability.

To increase the press-formability and to increase the allowance, cold-rolled steel sheets using Ti—Nb-base very low C steels were developed, as disclosed in JP-B-7-62209, (the term "JP-B" referred to herein signifies "Examined Japanese Patent Publication"), and JP-B-47796, which sheets have already been supplied to automobile manufacturers. Along with the improvement of material qualities, however, the forming conditions of the manufacturers have become stricter than ever. As a result, under recent press-conditions, steel sheets of the above-described Ti—Nb-base very low C steels give a problem of generation of press-rejection rate. With high strength steel sheets, also the frequency of press-rejection increases along with the widening of application components of that kind of steels.

In addition, the high strength galvanized steel sheets which undergo press-forming are requested to have deep-drawing performance and to have non-aging property to suppress generation of stretcher-strains. In the past, to improve the deep-drawing performance and the non-aging property, there were developed high strength steel sheets based on IF steels in which the contents of C and Mn are minimized, and Ti, Nb, and the like are added to fix harmful C and N as carbo-nitrides. The IF steels, however, have a problem of high sensitivity to the secondary working brittleness. Furthermore, since the grain boundary strength relatively decreases with the increase in the strength of the steel sheets, the secondary working brittleness likely occurs. Accordingly, the development of high strength steel sheets having excellent deep-drawing performance should emphasize the improvement of resistance to secondary working brittleness as a critical issue. There are several technologies to increase the resistance to secondary working brittleness while maintaining the characteristics almost equal with those of IF steels, as disclosed in JP-B-61-32375, JP-A-5-112845, (the term "JP-A" referred to herein signifies "Unexamined Japanese Patent Publication"), JP-A-5-70836, and JP-A-2-175837.

However, the steels of JP-B-61-32375 and JP-A-5-112845 increase the resistance to secondary working brittleness by leaving solid solution C therein, so that there is a problem of aging when the steels are allowed to stand in a relatively high ambient temperature, such as in summer, for a long period. The steels of JP-A-5-70836 increase the resistance to secondary working brittleness by the addition of B. Boron, however, segregates in grain boundaries to suppress the crystal rotation during cold-working, which hinders the development texture favorable in attaining high r value, and degrades the deep-drawing performance. The steels of JP-A-2-175837 increase the resistance to secondary working brittleness owing to the addition of Nb to bring the grain boundary shape in a saw-teeth shape, thus making grain boundary fracture difficult. Those types of characteristics, however, make the working difficult.

As for the press-formability of cold-rolled steel sheets, investigations have been conducted mainly from the standpoint of deep-drawing performance and of stretchability. Regarding the deep-drawing performance, increase in r value is focused on, as described in JP-A-5-58784 and JP-A-8-92656. When, however, the cold-rolled steel sheets described in JP-A-5-78784 and JP-A-8-92656 are applied to side panels which are formed mainly for stretching, the punch-shoulder portion where a flat deformation stretch forming is conducted may induce fracture owing to insufficient propagation of strain. To that type of fracture occurred during that kind of stretch-forming, no appropriate action can be given because the increased strength of the materials does not allow to give evaluation by the total elongation and the n value, which are applicable in conventional mild materials.

SUMMARY OF THE INVENTION

It is an object of the present invention to provide a steel sheet for press-forming, having large forming allowance during press-forming and giving reduced press-rejection rate, thus improving the productivity, and to provide a method for manufacturing thereof.

To attain the object, the present invention provides a steel sheet which consists essentially of: a ferritic phase having ferritic grains of 10 or more grain size number and ferritic grain boundaries; and at least one kind of precipitate selected from the group consisting of Nb-base precipitate and Ti-base precipitate, being included in the ferritic phase. Each of the ferritic grains has a low density region with a low precipitate density in the vicinity of grain boundary. The low-density region has a precipitate density of 60% or less to the precipitate density at center part of the ferritic grain.

The low density region preferably exists in a range of from 0.2 to 2.4 μm distant from the ferrite grain boundary.

The steel sheet preferably has a BH value of not more than 10 MPa.

The steel sheet preferably consists essentially of 0.002 to 0.02% C, 1% or less Si, 3% or less Mn, 0.1% or less P, 0.02% or less S, 0.01 to 0.1% sol.Al, 0.007% or less N, at least one element selected from the group consisting of 0.01 to 0.4% Nb and 0.005 to 0.3% Ti, by mass %, and balance of substantially Fe. The C content is more preferably from 0.005 to 0.01%. The Nb content is more preferably from 0.04 to 0.14%. The Nb content is most preferably from 0.07 to 0.14%. The Ti content is more preferably from 0.005 to 0.05%.

The steel sheet preferably consists essentially of 0.002 to 0.02% C, 1% or less Si, 3% or less Mn, 0.1% or less P, 0.02% or less S, 0.01 to 0.1% sol.Al, 0.007% or less N, 0.002% or less B, at least one element selected from the group consisting of 0.01 to 0.4% Nb and 0.005 to 0.3% Ti, by mass %, and balance of substantially Fe. The B content is more preferably 0.001% or less.

A method for manufacturing the steel sheet comprises the steps of: hot-rolling a slab to prepare a hot-rolled steel sheet; cooling the hot-rolled steel sheet to a temperatures of 750° C. or less at cooling speeds of 10° C./sec or more; coiling the cooled hot-rolled steel sheet; cold-rolling the coiled hot-rolled steel sheet to prepare a cold-rolled steel sheet; and annealing the cold-rolled steel sheet.

The slab consists essentially of 0.002 to 0.02% C, 1% or less Si, 3% or less Mn, 0.1% or less P, 0.02% or less S, 0.01 to 0.1% sol.Al, 0.007% or less N, at least one element selected from the group consisting of 0.01 to 0.4% Nb and 0.005 to 0.3% Ti, by mass %, and balance of substantially Fe.

The slab preferably consists essentially of: 0.002 to 0.02% C, 1% or less Si, 3% or less Mn, 0.1% or less P, 0.02% or less S, 0.01 to 0.1% sol.Al, 0.007% or less N, 0.002% or less B, at least one element selected from the group consisting of 0.01 to 0.4% Nb and 0.005 to 0.3% Ti, by mass %, and balance of substantially Fe.

The ferritic grains of the coiled hot-rolled steel sheet preferably have 11.2 or more grain size number.

The step of coiling the hot-rolled steel sheet is preferably carried out at coiling temperatures of from 500 to 700° C.

The step of cold-rolling the hot-rolled steel sheet is preferably carried out at least 85% of cold draft percentage.

The step of annealing the cold-rolled steel sheet is preferably carried out by continuous annealing at temperatures of from 900° C. to recrystallization temperature.

Furthermore, it is another object of the present invention to provide a method for manufacturing a high strength cold-rolled steel sheet and a high strength zinc-base coated steel sheet, which have surface quality, non-aging property, and workability applicable to outer body sheets of automobiles, and which have excellent resistance to secondary working brittleness.

To attain the object, the present invention provides a steel sheet which consists essentially of: 0.004 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, by mass %, and balance of substantially Fe; the Nb content satisfying a formula of $$(12/93)\times Nb^*/C \geqq 1.0$$

where, $Nb^*=Nb-(93/14)\times N$, and where, C, N, and Nb designate content of respective elements, (mass %); and yield strength and average grain size of the ferritic grains satisfying a formula of $$YP \leqq -120\times d+1280$$

Where, YP designates yield strength [MPa], and d designates average size of ferritic grains [μm].

The above-described steel sheet preferably has an n value determined by 10% or lower deformation in a uniaxial tensile test. satisfies a formula of $$n\ \text{value} \geqq -0.00029\times TS+0.313$$

where, TS designates tensile strength [MPa].

The C content is preferably from 0.005 to 0.008%. The Nb content is more preferably from 0.08 to 0.14%. The steel sheet preferably further contains 0.05% or less Ti. The steel sheet preferably further contains 0.002% or less B. The steel sheet preferably further contains at least one element selected from the group consisting of 1.0% or less Cr, 1.0% of less Mo, 1.0% or less Ni, and 1.0% or less Cu.

The steel sheet preferably has a zinc-base coating thereon.

A method for manufacturing steel sheet comprises the steps of: hot-rolling a slab at finish temperatures of $Ar_3$ transformation point or above; coiling the hot-rolled steel sheet at temperatures of from 500 to 700° C.; cold-rolling the coiled hot-rolled steel sheet; and annealing the cold-rolled steel sheet.

The slab consists essentially of 0.004 to 0.02% C, 1.0% or less Si, 0.7 to 3.0% Mn, 0.02 to 0.15% P, 0.02% or less S, 0.01 to 0.1% Al, 0.004% or less N, 0.035 to 0.2% Nb, by mass %, and balance of substantially Fe.

The method for manufacturing steel sheet preferably further contains a step for applying zinc-base coating on the steel sheet after annealed.

The slab preferably further contains 0.05% or less Ti.

The slab preferably further contains 0.002% or less B.

Furthermore, the present invention provides a steel sheet which consists essentially of: 0.0040 to 0.02% C, 1.0% or less Si, 0.1 to 1.0% Mn, 0.01 to 0.07% P, 0.02% or less S, 0.01 to 0.1% Al, 0.004% or less N, 0.15% or less Nb, by mass %, and balance of substantially Fe; the Nb content satisfying a formula of $$(12/93)\times Nb^*/C \geqq 1.2$$

where, $Nb^*=Nb-(93/14)\times N$, and where, C, N, and Nb designate content of respective elements, (mass %); and yield strength and average grain size of the ferritic grains satisfying a formula of $$YP \leqq -60\times d+770$$

Where, YP designates yield strength [MPa], and d designates average size of ferritic grains [μm].

The C content is more preferably from 0.005 to 0.008%. The Nb content is more preferable from 0.08 to 0.14%.

The steel sheet preferably has an n value determined by 10% or lower deformation in a uniaxial tensile test is 0.21 or more.

The steel sheet preferably further contains 0.05% or less Ti. The steel sheet preferably further containing at least one element selected from the group consisting of 1.0% or less Cr, 1.0% of less Mo, 1.0% or less Ni, 1.0% or less Cu.

The steel sheet preferably has a zinc-base coating thereon.

A method for manufacturing steel sheet comprises the steps of: hot-rolling a slab consisting essentially of 0.004 to 0.02% C, 1.0% or less Si, 0.1 to 1.0% Mn, 0.01 to 0.07% P, 0.02% or less S, 0.01 to 0.1% Al, 0.004% or less N, 0.035 to 0.15% Nb, by mass %, and balance of substantially Fe, at finish temperatures of Ar3 transformation point or above; coiling the hot-rolled steel sheet at temperatures of from 500 to 700° C.; cold-rolling the coiled hot-rolled steel sheet; and annealing the cold-rolled steel sheet.

EMBODIMENT FOR CARRYING OUT THE INVENTION

Embodiment 1

Figure 1:
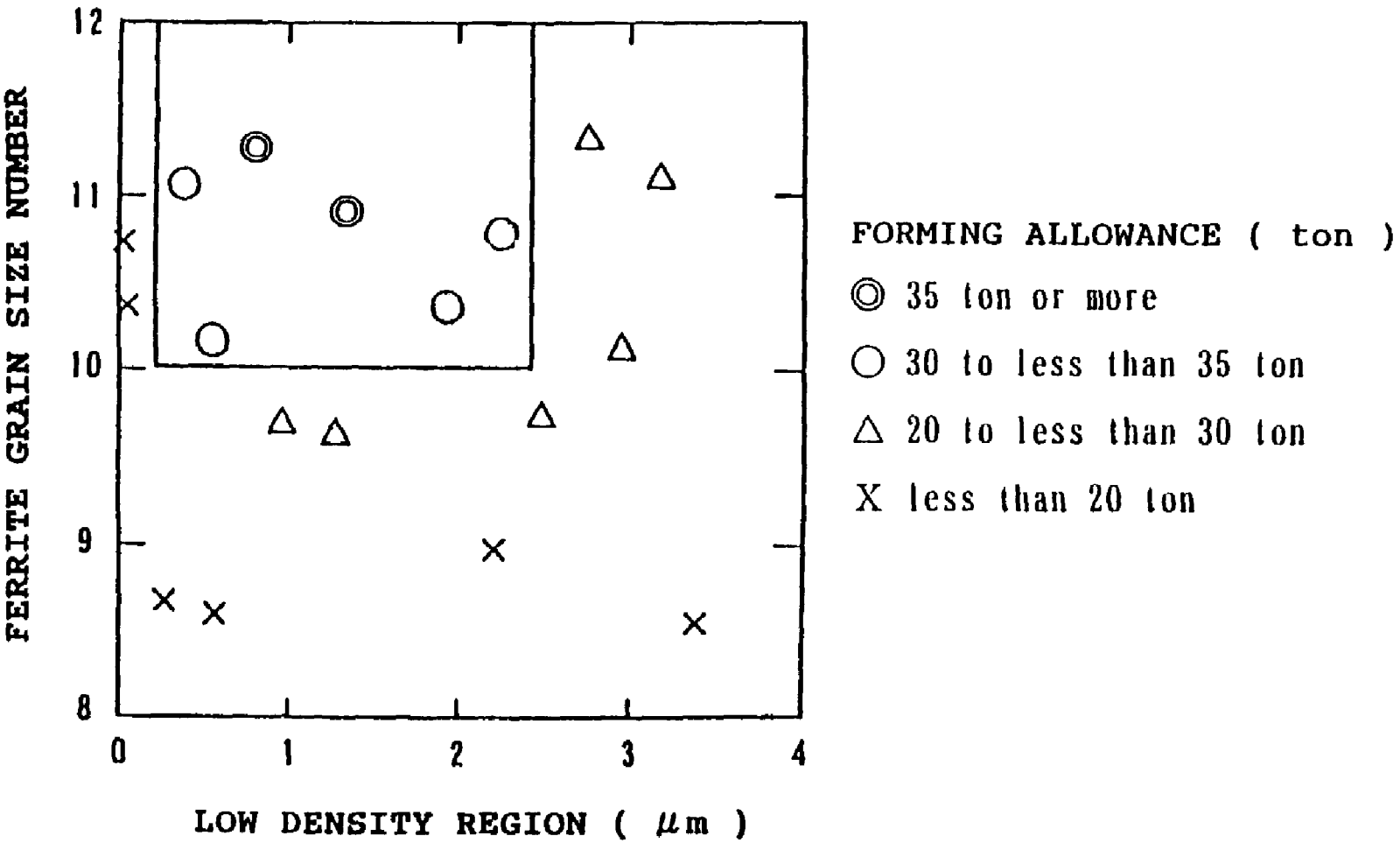
FIG. 1 is a graph showing the relation between the forming allowance (range of forming allowance) during the press-forming and the microscopic structure of a steel sheet, relating to the Embodiment 1.

The Embodiment 1 is a steel sheet for press-forming, in which a ferritic phase has ferritic grains of 10 or more grain size number, and contains at least one kind of precipitate selected from the group consisting of Nb-base precipitate and Ti-base precipitate, and has a low density region of low precipitate density in the vicinity of grain boundary, wherein the density of precipitates in the low density region is 60% or less to the precipitate density at center part of the ferritic grain.

The steel sheet may further have a low density region of low precipitate density in a range of from 0.2 to 2.4 μm distant from the ferrite grain boundary.

The steel sheet may further have BH values of not more than 10 MPa.

The Embodiment 1 was achieved after detailed investigations on the variables that govern the forming allowance in press-forming process. In the course of the investigations, the inventors of the present invention derived findings that the refinement of ferritic grains and the formation of low density region with low precipitate density in the vicinity of ferritic grain boundary increase the crack generation limit and the wrinkle generation limit, thus increasing the forming allowance during press-forming process, even with the same material characteristics.

Based on the findings, the inventors of the present invention found that the governing variables of the forming allowance are the grain size number of the ferritic grains and the range of the low density region. Regarding these variables, the relation with the forming allowance and the reasons of limitation are described below. The forming allowance is represented by the allowance of wrinkle-suppression load during the actual press-forming of components, or the magnitude of load range (difference in load) between the load that stops wrinkle generation with increasing in load, (wrinkle limit), and the load immediately before the generation of crack, (crack limit).

Grain size number of ferritic grains: 10 or more

If the ferritic grains become coarse to reduce the grain size number to below 10, the generation of cracks becomes significant, which makes the forming allowance small, thus resulting in substantially incapable of forming. Therefore, the grain size number of the ferritic grains is specified to 10 or more.

Precipitate density in the vicinity of grain boundary: 60% or less to the precipitate density at center part of the ferritic grain If the precipitate density of the low density region exceeds 60% to the center part of the ferritic grain, the difference of the precipitate density between the periphery of grain boundary and the inside of grain, the generation of wrinkles becomes significant. As a result, the effect of the present invention to increase the forming allowance through the formation of regions different in precipitate density to each other cannot be obtained. Therefore, the precipitate density in the vicinity of the ferritic grain boundary is specified to 60% or less to that at center part of the ferritic grain.

Range of low density region: from 0.2 to 2.4 μm distant from the ferrite grain boundary If the range of the low density region is less than 0.2 μm distant from the ferrite grain boundary, the periphery of ferrite grain boundary becomes substantially free from the low density region, which induces significant generation of wrinkles, thus resulting in a small forming allowance. Inversely, if the range of the low density region exceeds 2.4 μm distant from the ferrite grain boundary, the percentage of low density region in the ferritic grain becomes excessively large, which induces significant generation of cracks, thus failing in increasing the forming allowance. Therefore, to further increase the forming allowance, the range of the low density region is specified from 0.2 to 2.4 μm distant from the ferrite grain boundary.

BH Value: 10 MPa or Less

If the BH value (coating baking and baking quantity) of a steel sheet exceeds 10 MPa. Both the wrinkles and the cracks caused from the existing solid solution C are likely generated, which reduces the forming allowance. The determination of the BH value is conducted in accordance with JIS G3135 "Cold Rolled High Strength Steel Sheets with Improved Formability for Automobile Structural Uses" annex "Testing Method for Coating and Baking Quantity".

For the above-described steel sheet for press-forming, the chemical compositions can be selected to the following.

The chemical composition of a steel sheet for press-forming consists essentially of 0.002 to 0.02% C, 1% or less Si, 3% or less Mn, 0.1% or less P, 0.02% or less S, 0.01 to 0.1% sol.Al, 0.007% or less N, at least one element selected from the group consisting of 0.01 to 0.4% Nb and 0.005 to 0.3% Ti, by mass %, and balance of substantially Fe. The above-described chemical composition may further contain 0.002% or less B.

The reasons of limiting the above-described chemical compositions are described below.

C: 0.0002 to 0.02% (Mass %, and so Forth)

Carbon is an important element to form carbides with Nb and Ti, and to form regions different in precipitation density to each other in the vicinity and at center part of a ferritic grain. If the C content is less than 0.002%, the precipitate density in the ferritic grain becomes excessively low to bring the difference of precipitate density between the periphery of ferritic grain and the center part of the ferritic grain small, which failing in sufficiently reducing the wrinkle limit load, thus failing in attaining large forming allowance.

If the C content exceeds 0.02%, the precipitate density inside of a ferritic grain becomes excessively high, which cannot fully increase the precipitate density in the vicinity of ferritic grain, thus the difference in the precipitate density becomes small. As a result, the ductility degrades to likely induce press-cracks and the crack limit load reduces, which reduces the forming allowance. Consequently, the C content is specified to a range of from 0.002 to 0.02%, more preferably from 0.005 to 0.01%.

Si: 1.0% or Less

Silicon is an element to increase the strength by strengthening solid solution, and can be added responding to the wanted level of strength. However, the addition of Si higher than 1.0% results in significant reduction in ductility, thus inducing press-crack generation, so that the forming allowance becomes small. Therefore, the Si content is specified to 1.0% or less.

Mn: 3.0% or Less

Manganese increases the strength without degrading the coating adhesiveness through the grain refinement and the strength of solid solution in a hot-rolled sheet. However, the addition of Mn higher than 3.0% results in significant reduction in ductility to induce press cracks, thus reducing the forming allowance, and reducing the hot-workability. Therefore, the Mn content is specified to 3.0% or less.

P: 0.1% or Less

Phosphorus is an effective element to strengthen steel. However, P enhances the formation of ferritic grains to coarsen the grains in hot-rolled sheet. If P is excessively added over 0.1%, the ductility significantly reduces, and press cracks are generated, then the forming allowance becomes small, further the hot-workability degrades. Therefore, the P content is specified to 0.1% or less.

S: 0.02% or Less

Sulfur exists in steel as a sulfide. If the S content exceeds 0.02%, the ductility is degraded, the press cracks likely occur, and the forming allowance becomes small. Therefore, the S content is specified to 0.02% or less.

sol.Al: 0.01 to 0.1%

Aluminum has functions to let N precipitate as AlN, and to reduce the bad influence of solid solution N (decreasing the ductility by strain aging). If the content of sol.Al is less than 0.01%, the effect cannot fully been attained. And, if sol.Al is added to over 0.1%, the effect cannot be increased for the added amount. Therefore, the sol.Al content is specified to a range of from 0.01 to 0.1%.

N: 0.07% or Less

Nitrogen precipitates as AlN. When Ti or B is added, N precipitates as TiN or BN. In both cases, N becomes harmless. However, in view of the steel making technology, less N content is more preferable. If the N content exceeds 0.007%, particularly the reduction of effect of the Ti and B addition cannot be neglected, and the BH value increases. Therefore, the N content is specified to 0.007% or less.

Nb: 0.01 to 0.4%

Niobium is an important element that forms a carbide bonding with C, and that, along with Ti described below, makes the periphery and the center part of ferritic grain regions different in precipitate density from each other. However, if the Nb content is less than 0.01%, the precipitate density in the vicinity of ferritic grain becomes low, and the difference of precipitate density between the periphery of ferritic grain and the inside of the ferritic grain becomes small, so that the wrinkle limit load cannot fully be reduced, and large forming allowance cannot be attained. On the other hand, if the Nb content exceeds 0.4%, the precipitate density inside of ferritic grain excessively increases, and the difference in precipitate density becomes small. As a result, the ductility degrades to induce press cracks and to reduce the forming allowance. Therefore, the Nb content is specified to a range of from 0.01 to 0.4% without or with the addition of Ti. The Nb content of 0.04 to 0.14% is more preferable.

Ti: 0.005 to 0.3%

Similar with Nb, Ti binds with C to form a carbide. Titanium is an important element to make the periphery of ferritic grain and the center part of the ferritic grain regions different in precipitate density from each other. If, however, the Ti content is less than 0.005%, the precipitate density in a ferritic grain becomes low, and the difference of precipitate density between the periphery of ferritic grain and the inside of ferritic grain becomes less, so that the wrinkle limit load cannot fully be reduced, and large forming allowance cannot be attained. On the other hand, if the Ti content exceeds 0.3%, the precipitate density inside of a ferritic grain becomes excessively large, and the difference in the precipitate density becomes small. As a result, the ductility reduces to induce press cracks, and the forming allowance reduces. Therefore, the Ti content is specified to a range of from 0.005 to 0.3% without or with the addition of Nb.

B: 0.002% or Less

The effect of the present invention according to the Embodiment 1 is fully performed by the above-described chemical compositions. To further improve the resistance to secondary working brittleness, however, B may further be added. In that case, if the B content exceeds 0.002 wt. %, the formability significantly degrades. Therefore, if B is added, the content is specified to 0.002% or less.

The method for manufacturing the above-described steel sheet for press-forming is described below.

The above-described steel sheet for press-forming is obtained by using the steel having the above-described chemical composition, by applying hot-rolling and finish rolling, by cooling the rolled sheet at least down to 750° C. at cooling speeds of 10° C./sec or more, by coiling the hot-rolled sheet, then by applying cold-rolling and annealing.

The manufacturing method is preferably to obtain the above-described microscopic structure. In particular, the condition for rapid cooling after the hot-rolling and finish rolling is specified. The condition for cooling after the hot-rolling and finish rolling gives significant influence on the formation of above-described low density region in the cold-rolled sheet.

Cooling Speed: 10° C./s or More

With the cooling speed of less than 10° C./s, the precipitates of Ti and Nb become coarse during the cooling of hot-rolled sheet, which induces reduction of the density of precipitates in the cold-rolled sheet, thus reducing the difference of the precipitate density at periphery of ferritic grain boundary and inside of the ferritic grain. As a result, the low density region substantially failed to form.

Temperature Range of Rapid Cooling: at Least Down to 750° C.

If the rapid cooling is stopped at temperatures above 750° C., coarse precipitates of Ti-base and Nb-base appear during the succeeding gradual cooling stage. As a result, similar with the case of slow speed of above-described cooling speed, the density of precipitates in the cold-rolled sheet reduces, thus substantially failing to form the low density region.

Furthermore, the present invention can bring the ferritic grains in the hot-rolled sheet after the hot-rolled sheet coiling to 11.2 or higher grain size number. In this manner, the refinement of the ferritic grain size in the hot-rolled sheet allows to obtain extremely large forming allowance as described later.

The steel sheet according to the present invention provides a steel sheet with excellent formability by specifying the above-described microscopic structure. The detail is described below.

Figure 2:
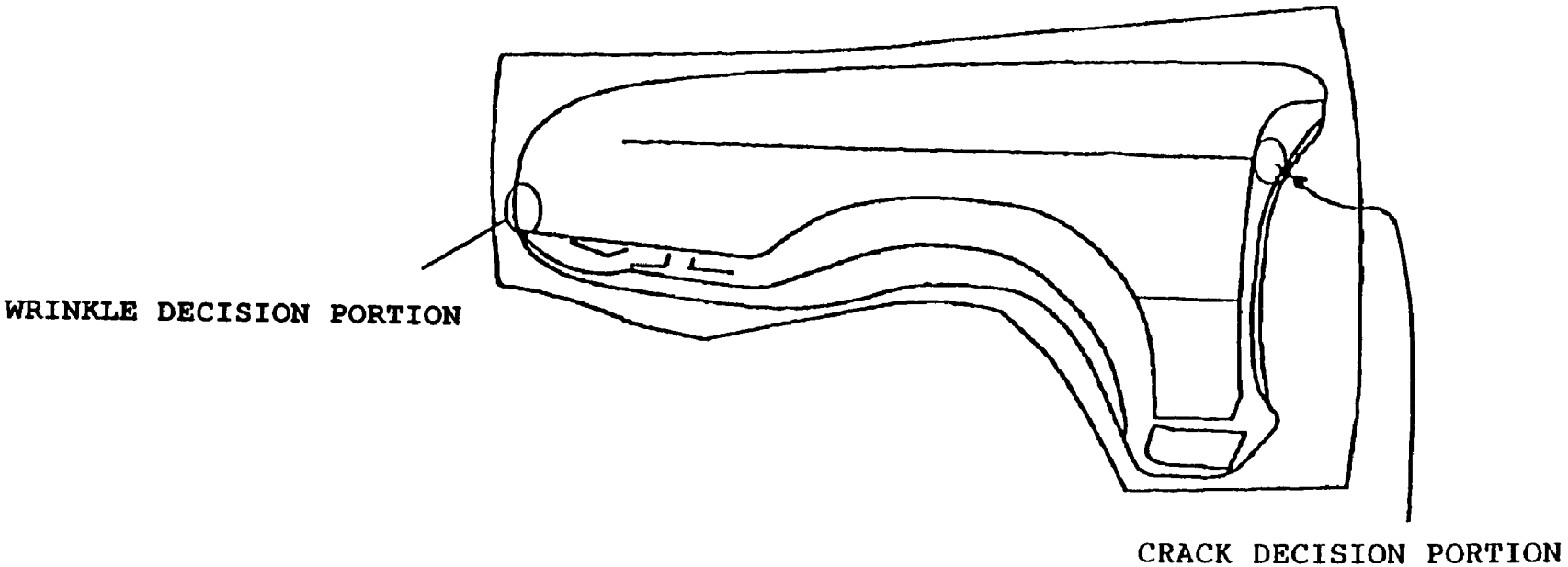
FIG. 2 illustrates appearance of a front fender model of actual component scale of automobile.

FIG. 1 is a graph showing the relation between the forming allowance (range of forming allowance) during the press-forming and the microscopic structure of steel sheet. The steel sheet tested is an IF cold-rolled steel sheet of TS=340 MPa class having a sheet thickness of 0.80 mm. The press-forming test was carried out, as shown in FIG. 2, using a front fender model of actual component scale of automobile to determine respective limit loads for generating cracks and wrinkles. The forming allowance (crack generation limit load—wrinkle generation limit load) was calculated from the difference between the loads.

To obtain a preferable forming allowance (30 T or more; marks ○ and ◎ in the figure), the figure suggests that the ferritic grains in the steel sheet may have 10 or larger grain size number, (or refinement). The determination of the grain size number was given in accordance with JIS G0552. In a similar manner, to obtain preferable forming allowance, the magnitude of the low density region may have a range of from 0.2 to 2.4 μm.

The determination of the precipitate density was given on photographs using a replica method under a transmission electron microscope at 300 kV of acceleration voltage. In concrete terms, 100 ferritic grains were arbitrarily sampled from the photographs, and the area rate of the precipitates within a circle of 2 μm of diameter at arbitrary ten points within each ferritic grain was determined. The average value of these total 1,000 points of observation was adopted as the precipitate density in ferritic grain. Then, at 20 arbitrary points in the vicinity of the ferritic grain boundaries, the maximum diameter of the circle that gives 60% or less of the precipitate density to the precipitate density within the ferritic grain was determined. Finally, the average value of these total 2,000 points was calculated, and the average was adopted as the average size of the low density region.

The precipitate density of the low density region in the vicinity of ferritic grain may be 60% or less to that at center part of the ferritic grain. To maximize the effect of the present invention, however, 20% or less is preferred.

Regarding the chemical composition, the following is preferred.

Carbon is preferably in a range of from 0.004 to 0.01% (mass %, and so forth) to increase the difference of precipitate density between the periphery of ferritic grain and the inside of the ferritic grain, thus enhances the effect of the present invention.

Silicon is preferably 0.5% or less to prevent the degradation of chemical conversion treatment performance of a cold-rolled steel sheet and to prevent the degradation of coating adhesiveness on galvanized steel sheet.

Manganese is preferably 2.5% or less to reduce the press-forming allowance caused from the reduction in ductility and to further reduce the hot-workability.

Phosphorus is preferably 0.08% or less to prevent significant degradation of alloying treatment performance in the case of application to galvanized steel sheet, and to prevent the insufficient adhesion of coating and the generation of bad appearance of panels caused from the insufficient adhesion of the coating.

By specifying the sol.Al content to the range of present invention described above, the harm of solid solution N which degrades the local ductility caused from strain aging phenomenon can be reduced.

Niobium is preferably in a range of from 0.04 to 0.14% to attain further adequate precipitate density, thus improving the effect of the present invention.

Titanium is preferably 0.05% or less to prevent significant degradation of the surface properties for the case of applying the steel sheet to the hot dip galvanized steel sheet. Furthermore, by specifying the Ti content to 0.02% or less, extremely high coating surface quality is attained.

Boron is preferably 0.001% or less to hinder the grain growth during annealing, thus preventing the reduction in elongation and in r value, to prevent the degradation of press-formability. To improve the resistance to secondary working brittleness, at least 0.0001% of Ti addition is necessary.

Regarding the manufacturing method, steel slabs having the compositions specified in the Embodiment of the present invention are subjected to a series of treatments, hot-rolling, pickling, cold-rolling, annealing, and the like, furthermore, applying plating at need. The following is the description of a preferred mode for carrying out the present invention.

As for the hot-rolling, various methods can be applied, such as an ordinary hot-rolling process in which the rolling is applied after heating a slab, and a method of rolling as continuously-cast or after applying a short time of heating treatment after the continuous casting. In these cases, to provide the final product with excellent surface properties after plating free from non-sheetd section and insufficient coating adhesion, it is preferred to fully remove not only the primary scale appeared on the slab but also the secondary scale formed during the hot-rolling treatment. During the heat-rolling, a bar heater may be applied to heat a sheet bar to conduct temperature control or the like.

During the coiling after cooled the hot-rolled sheet, the Ti-base and Nb-base precipitates are refined to attain an adequate precipitate density in the cold-rolled sheet. If the coiling temperature is below 500° C., the precipitates are not fully formed, and the effect is less. On the other hand, if the coiling temperature exceeds 700° C., the precipitates become coarse, and the descaling performance degrades. Therefore, the coiling temperature is preferably in a range of from 500 to 700° C.

Figure 3:
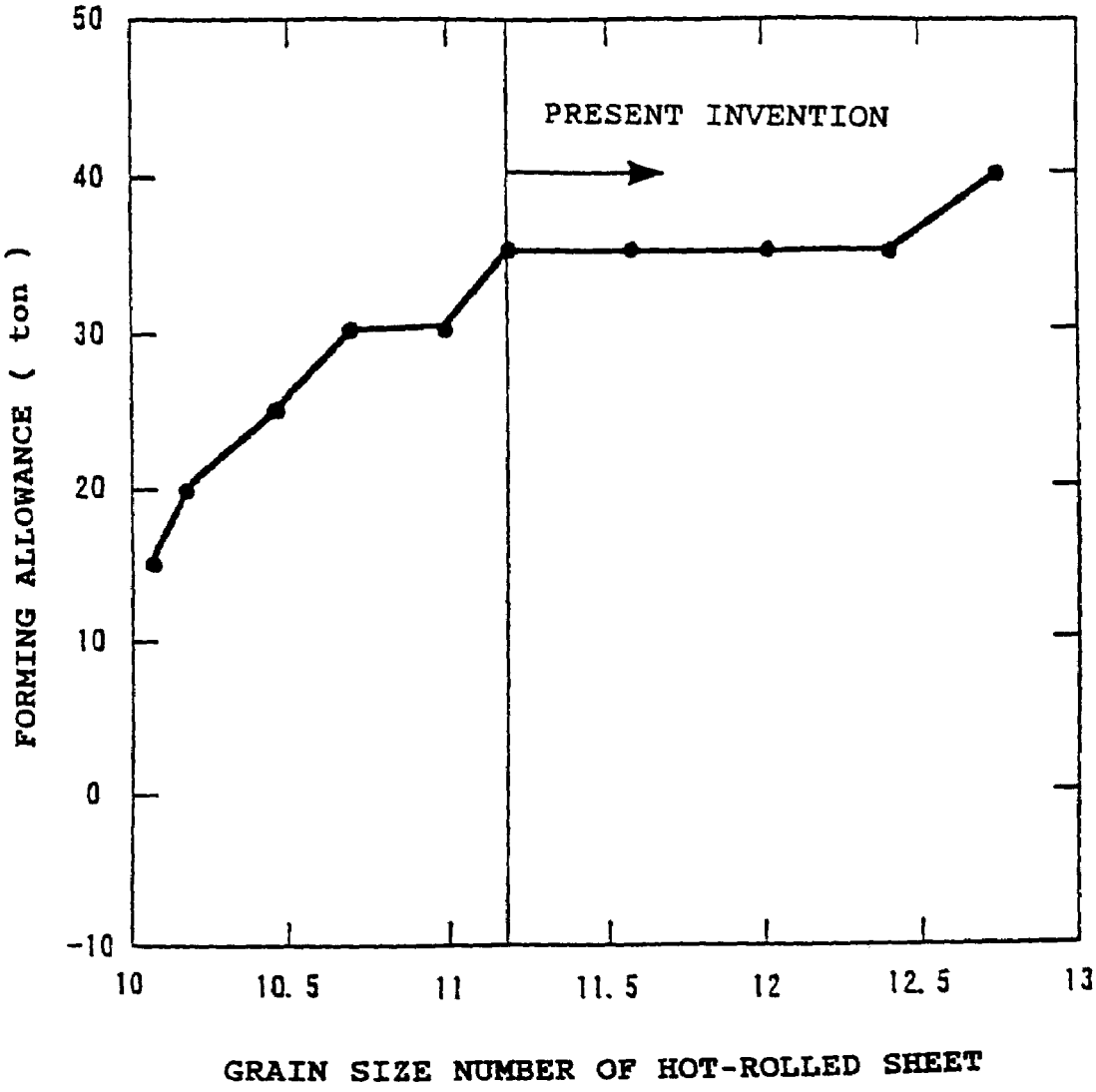
FIG. 3 is a graph showing the influence of the ferritic grain size in a hot-rolled sheet on the forming allowance, relating to the Embodiment 1 for carrying out the invention.
Figure 4:
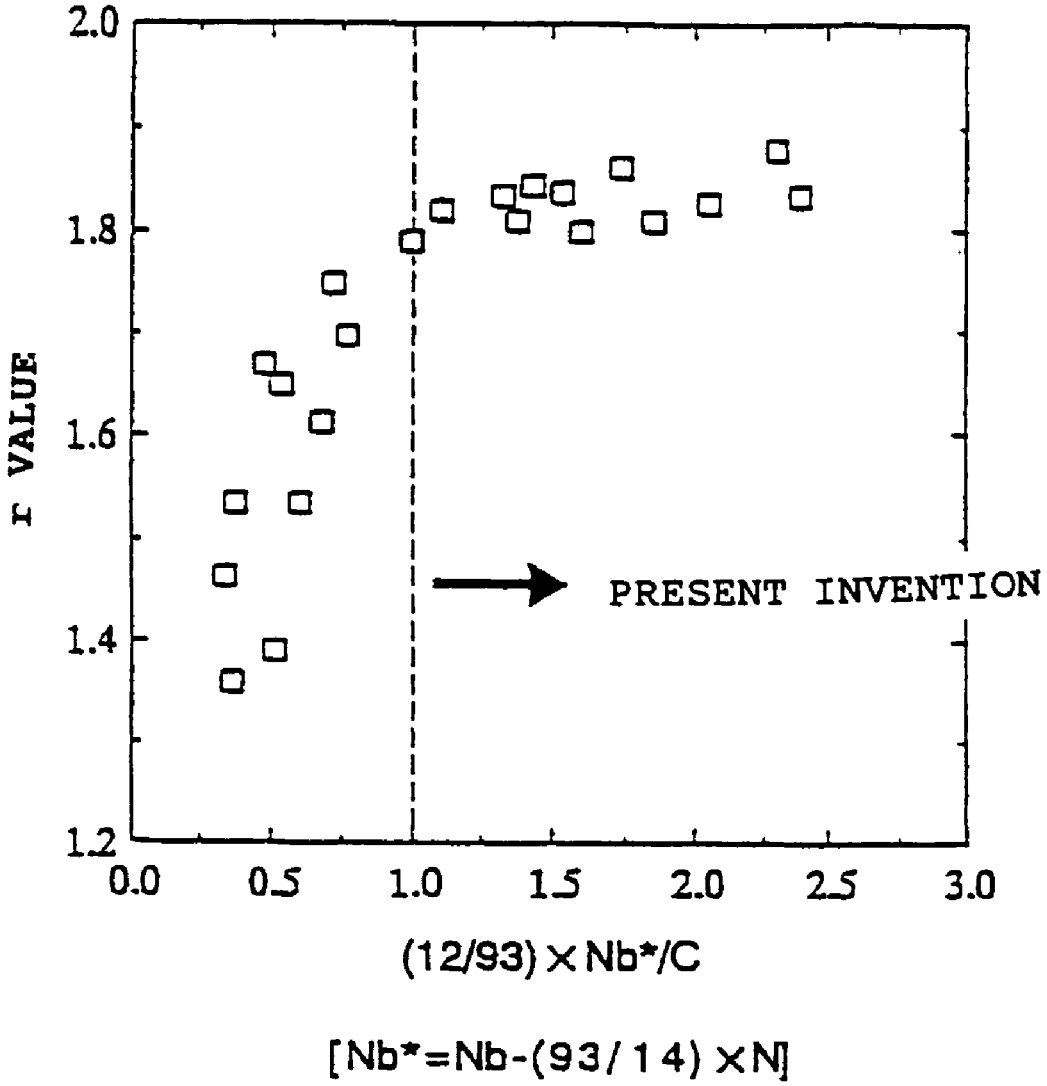
FIG. 4 is a graph showing the relation between (12/93)× Nb*/C and the r value, relating to the Embodiment 2.

The influence of the ferritic grain size in the hot-rolled sheet after coiling the hot-rolled sheet is shown in FIG. 3. FIG. 4 shows the relation between the ferritic grain size at a stage of hot-rolled sheet and the press-forming allowance of the cold-rolled sheet for the cold-rolled sheets having 10 or larger grain size number of ferritic grains and having 0.2 to 2.4 μm of low density regionsize. The figure shows that extremely large forming allowance can be attained by controlling the grain size number to 11.2 or more.

As for the cold draft percentage, above 85% gives excessively heavy rolling load to degrade the productivity. Therefore, the cold draft percentage is preferably 85% or less.

For the annealing, continuous annealing at temperatures of from recrystallization temperature to 900° C. is preferred. If the annealing temperature exceeds 900° C., abnormal grain growth may occur to degrade the material quality, further the crystal orientation (texture) of the ferritic grains becomes random, which is unfavorable in view of press-formability. For the case of box annealing, the heating speed is slow so that precipitates appear in cold-working structure in regions below the recrystallization temperature, which fails to attain adequate precipitate density specified by the present invention after annealing.

EXAMPLE 1

Steels Nos. A through Q each having respective chemical compositions given in Table 1 were prepared by melting process, which were then treated by continuous casting to obtain slabs having a thickness of 220 mm. Each of the slabs was heated, and hot-rolled at finish temperatures of from 880 to 920° C., then was cooled at cooling speeds of from 5 to 15° C./s, and was coiled at coiling temperatures of from 640 to 700° C. to prepare a hot-rolled steel sheet having a thickness of 3.2 mm. The hot-rolled steel sheet was pickled and was cold-rolled to a thickness of 0.8 mm.

After that, either of continuous annealing (at temperatures of from 750 to 890° C.) or continuous annealing+hot dip galvanizing (at annealing temperatures of from 830 to 850° C.) was applied to the cold-rolled steel sheet. As for the continuous annealing+hot dip galvanizing, the hot dip galvanizing was given at 460° C. after the annealing, then immediately applied the alloying treatment on the coating layer at 500° C. in an in-line alloying treatment furnace. For the hot dip galvanizing, the coating was given on both sides of the sheet at a coating weight of 45 g/m$^2$ on each side. For the steel sheet after annealing or annealing+hot dip galvanizing, temper rolling was applied to 0.7% of draft percentage.

For thus prepared cold-rolled steel sheets and sheetd steel sheets, the mechanical properties and the microscopic structure were determined. The tensile test was given by sampling the JIS Specimens in the three directions, 0°, 45°, and 90° to the drawing direction. For the sheetd steel sheets, tensile test was given after peeling the coating layer therefrom. As for the determined tensile strength, total elongation, and r value, the following-given formulae were applied to determine the intraplane average values of TS, El, and r.

$$TS=(TS0+TS45+TS90)/4$$

$$El=(El0+El45+El90)/4$$

$$r=(r0+R54+R90)/4$$

where, the suffixes 0, 45, and 90 designate the observed values at 0°, 45°, and 90° to the rolling direction, respectively.

The BH value was determined by JIS G3135 "Cold Rolled High Strength Steel Sheets with Improved Formability for Automobile Structural Uses" annex "Testing Method for Coating and Baking Quantity". That is, after applying 2% pre-strain to a specimen, the heat treatment was given under a coating and baking condition of 170° C. for 20 minutes, then the magnitude of strength increase was determined.

With the same method described above, each of these cold-rolled steel sheets was press-formed, and the press-forming allowance was determined. For the hot dip galvanized steel sheets, surface property after plating was evaluated. The test results are shown in Table 2 and Table 3 for each strength (TS) level.

The terms appeared in Table 2 and Table 3 are the following.

CGL: Continuous annealing and hot dip galvanizing

CAL: Continuous annealing

CR: Cooling speed

T: Cooling end temperature

CT: Coiling temperature underline: Outside of the range of the present invention density: Precipitate density in a low density region forming allowance: (Crack limit load)—(Wrinkle limit load)

poor sheetd surface property: Non-coated or insufficient coating adhesiveness

As clearly shown in Table 2 and Table 3, the Examples of the present invention satisfied the microscopic structure of the present invention, thus attaining larger press-forming allowance than that of Comparative Examples. The steel sheets having the compositions according to the present invention and prepared by the manufacturing method according to the present invention satisfied the microscopic structure of the present invention. The steel sheets using the steels having the compositions according to the present invention and controlling the Ti content were free from non-coated section and insufficient coating adhesiveness, and gave superior surface property after sheetd.

To the contrary, for the Comparative Examples, No. 6 which used a very low C steel (Steel No. C) accepted as a good material showed no low density region, gave coarse grains in hot-rolled sheet, and gave less press-forming allowance.

No. 8 (Steel No. D) and No. 16 (Steel No. H) containing less Nb and Ti showed less difference when the BH value increases because the precipitation density totally became low, thus the precipitate density in a low density region exceeded 60%, and the press-forming allowance became small. No. 22 (Steel No. K) containing large amount of C and Nb showed less difference because the precipitate density became totally large, thus the precipitate density in a low density region exceeded 60%, and the press-forming allowance became small.

No. 14 (Steel No. G) containing large amount of B. No. 24 (Steel No. L) containing large amount of Si, No. 30 (Steel No. O) containing large amount of Mn, and No. 32 (Steel No. P) containing large amount of P reduced both elongation and r value, and the microscopic structure became outside of the range of the present invention, and the press-forming allowance became small.

No. 11, No. 13, No. 19, and No. 21 had microscopic structure outside of the range of the present invention so that the press-forming allowance became less, though the conditions of composition and hot-rolling were within the range of the present invention.

With the hot-rolling conditions, No. 3 and No. 27 giving a low cooling speed CR, and No. 5 and No. 29 giving a high temperature to stop rapid cooling, T, gave insufficient formation of low density region, and the press-forming allowance became less.

No. 33 (Steel No. Q) giving high BH value reduced both the elongation and the r value, and decreased the press-forming allowance.

As for the coating surface property, No. 14 (Steel No. G) containing large amount of B, No. 24 (Steel No. L) containing large amount of Si, No. 30 (Steel No. O) containing large amount of Mn, and No. 32 (Steel No. P) containing large amount of P showed non-coating section and insufficient coating adhesiveness.

TABLE 1

(mass %)

| Steel No. | C | Si | Mn | P | S | sol.Al | N | Nb | Ti | B | Remark |
|---|---|---|---|---|---|---|---|---|---|---|---|
| A | 0.0045 | 0.01 | 0.15 | 0.009 | 0.010 | 0.045 | 0.0025 | 0.070 | — | — | Example steel |
| B | 0.0030 | 0.02 | 0.13 | 0.012 | 0.008 | 0.040 | 0.0018 | 0.031 | 0.018 | — | Example steel |
| C | 0.0018 | 0.01 | 0.15 | 0.006 | 0.011 | 0.043 | 0.0022 | 0.020 | 0.025 | — | Prior art steel |
| D | 0.0042 | 0.01 | 0.12 | 0.008 | 0.009 | 0.048 | 0.0016 | 0.005 | — | — | Comparative example steel |
| E | 0.0062 | 0.01 | 0.30 | 0.022 | 0.008 | 0.050 | 0.0028 | 0.095 | — | — | Example steel |
| F | 0.0050 | 0.01 | 0.60 | 0.010 | 0.012 | 0.042 | 0.0032 | — | 0.060 | — | Example steel |
| G | 0.0048 | 0.02 | 0.20 | 0.030 | 0.007 | 0.045 | 0.0023 | 0.015 | 0.035 | 0.0022 | Comparative example steel |
| H | 0.0070 | 0.01 | 0.35 | 0.018 | 0.012 | 0.040 | 0.0021 | — | 0.003 | — | Comparative example steel |
| I | 0.0068 | 0.02 | 1.30 | 0.041 | 0.009 | 0.051 | 0.0019 | 0.110 | — | — | Example steel |
| J | 0.0145 | 0.02 | 1.05 | 0.036 | 0.008 | 0.043 | 0.0047 | — | 0.174 | 0.0004 | Example steel |
| K | 0.0220 | 0.01 | 0.82 | 0.032 | 0.011 | 0.045 | 0.0062 | 0.322 | 0.088 | — | Comparative example steel |
| L | 0.0052 | 1.20 | 0.20 | 0.015 | 0.010 | 0.040 | 0.0021 | 0.089 | — | — | Comparative example steel |
| M | 0.0080 | 0.24 | 2.05 | 0.038 | 0.008 | 0.042 | 0.0018 | 0.126 | — | — | Example steel |
| N | 0.0096 | 0.02 | 1.95 | 0.077 | 0.012 | 0.054 | 0.0023 | 0.148 | — | — | Example steel |
| O | 0.0046 | 0.01 | 3.16 | 0.052 | 0.007 | 0.045 | 0.0030 | — | 0.050 | — | Comparative example steel |
| P | 0.0063 | 0.02 | 0.89 | 0.110 | 0.009 | 0.040 | 0.0016 | 0.103 | — | — | Comparative example steel |
| Q | 0.0080 | 0.20 | 2.10 | 0.041 | 0.011 | 0.052 | 0.0026 | 0.052 | — | — | Comparative example steel |

TABLE 2

| | | | | Hot-rolling condition (cooling - coiling) | | | Annealing temperature | Mechanical properties: average (45° direction) | | | |
|---|---|---|---|---|---|---|---|---|---|---|---|
| Strength level (MPa) | No. | Steel No. | Kind | CR (° C./s) | T (° C.) | CT (° C.) | AT (° C.) | TS (MPa) | EL (%) | r value | BH (MPa) |
| 270 | 1 | A | CGL | 15 | 710 | 640 | 850 | 294 <298> | 49.6 <49.2> | 2.19 <2.17> | 1 |
| | 2 | A | CAL | 15 | 710 | 640 | 850 | 298 <303> | 50.0 <49.7> | 2.18 <2.11> | 3 |
| | 3 | A | CGL | 5 | 710 | 640 | 850 | 289 | 50.3 | 2.14 | 2 |
| | 4 | B | CGL | 15 | 710 | 640 | 850 | 282 | 50.8 | 2.11 | 5 |
| | 5 | B | CGL | 15 | 780 | 640 | 850 | 273 | 49.2 | 2.06 | 2 |
| | 6 | C | CGL | 15 | 710 | 640 | 850 | 297 <301> | 51.3 <50.4> | 2.19 <2.16> | 6 |
| | 7 | C | CAL | 15 | 710 | 640 | 850 | 292 <295> | 51.6 <51.0> | 2.21 <2.18> | 5 |
| | 8 | D | CGL | 15 | 710 | 640 | 850 | 308 | 48.7 | 1.98 | 31 |
| 340 | 9 | E | CAL | 15 | 710 | 640 | 830 | 347 | 42.6 | 1.82 | 4 |
| | 10 | E | CGL | 15 | 710 | 640 | 830 | 351 | 42.2 | 1.80 | 3 |
| | 11 | E | CAL | 15 | 710 | 640 | 750 | 352 | 42.1 | 1.76 | 1 |
| | 12 | F | CAL | 15 | 710 | 640 | 750 | 355 | 43.2 | 1.80 | 2 |
| | 13 | F | CAL | 15 | 710 | 640 | 890 | 342 | 43.8 | 1.88 | 3 |
| | 14 | G | CAL | 15 | 710 | 640 | 850 | 353 | 39.8 | 1.58 | 6 |
| | 15 | G | CGL | 15 | 710 | 640 | 830 | 355 | 41.9 | 1.76 | 5 |
| | 16 | H | CAL | 15 | 710 | 640 | 830 | 358 | 41.7 | 1.74 | 39 |

| | | | Microscopic structure | | | | | | |
|---|---|---|---|---|---|---|---|---|---|
| Strength level (MPa) | No. | Steel No. | Grain size number in hot-rolled sheet | Grain size number of ferritic grain | Low density Region (μm) | Density (%) | Forming allowance (TON) | Coating surface property | Remark |
| 270 | 1 | A | 11.8 | 10.5 | 1.2 | 46 | 60 | Good | E |
| | 2 | A | 11.9 | 10.7 | 1.1 | 28 | 65 | — | E |
| | 3 | A | 10.9 | 10.2 | 0.1 | 53 | 30 | Good | C |
| | 4 | B | 11.5 | 10.3 | 1.3 | 20 | 50 | Good | E |
| | 5 | B | 11.3 | 10.1 | 0 | 100 | 25 | Good | C |
| | 6 | C | 10.2 | 8.8 | 0 | 100 | 30 | Good | C (P) |
| | 7 | C | 10.1 | 8.9 | 0 | 100 | 35 | — | C (P) |
| | 8 | D | 11.2 | 10.2 | 2.2 | 85 | 20 | Good | C |

TABLE 2-continued

| | | | | | | | | | |
|---|---|---|---|---|---|---|---|---|---|
| 340 | 9 | E | 12.2 | 10.9 | 0.8 | 18 | 35 | — | E |
| | 10 | E | 12.3 | 11.1 | 0.9 | 21 | 35 | Good | E |
| | 11 | E | 12.5 | 11.1 | 0.1 | 34 | 5 | — | C |
| | 12 | F | 11.1 | 10.6 | 1.4 | 23 | 35 | — | E |
| | 13 | F | 11.8 | 10.2 | 3.2 | 54 | 5 | — | C |
| | 14 | G | 12.1 | 10.8 | 0.1 | 58 | 0 | — | C |
| | 15 | G | 10.9 | 10.0 | 1.5 | 68 | 10 | Bad | C |
| | 16 | H | 11.0 | 10.1 | 1.8 | 76 | 5 | — | C |

E: Example
C: Comparative example
(P): Prior Art Example

TABLE 3

| Strength level (MPa) | No. | Steel No. | Kind | Hot-rolling condition (cooling - coiling) CR (° C./s) | T (° C.) | CT (° C.) | Annealing temperature AT (° C.) | Mechanical properties: average TS (MPa) | EL (%) | r value | BH (MPa) | Microscopic structure: Grain size number in hot-rolled sheet | Grain size number of ferritic grain | Low density Region (μm) | Density (%) | Forming allowance (TON) | Coating surface property | Remark |
|---|---|---|---|---|---|---|---|---|---|---|---|---|---|---|---|---|---|---|
| 390 | 17 | I | CAL | 15 | 710 | 640 | 830 | 402 | 39.4 | 1.82 | 0 | 12.7 | 11.6 | 0.9 | 16 | 15 | — | E |
| | 18 | I | CGL | 15 | 710 | 640 | 830 | 399 | 39.7 | 1.85 | 2 | 12.5 | 11.5 | 0.8 | 20 | 15 | Good | E |
| | 19 | I | CAL | 15 | 710 | 700 | 830 | 396 | 40.2 | 1.77 | 1 | 12.3 | 11.2 | 0.1 | 52 | 0 | — | C |
| | 20 | J | CAL | 15 | 710 | 700 | 830 | 410 | 39.1 | 1.83 | 3 | 13.0 | 11.9 | 0.6 | 14 | 15 | — | E |
| | 21 | J | CAL | 15 | 710 | 600 | 830 | 401 | 38.6 | 1.80 | 2 | 13.2 | 12.1 | 0.0 | 100 | −5 | — | C |
| | 22 | K | CAL | 15 | 710 | 640 | 830 | 421 | 37.9 | 1.76 | 7 | 13.5 | 12.4 | 1.3 | 92 | −5 | — | C |
| | 23 | L | CAL | 15 | 710 | 640 | 830 | 416 | 35.8 | 1.77 | 1 | 11.1 | 10.9 | 0.1 | 31 | −5 | — | C |
| | 24 | L | CGL | 15 | 710 | 640 | 830 | 419 | 35.6 | 1.78 | 0 | 11.0 | 10.8 | 0.1 | 26 | −10 | Bad | C |
| 440 | 25 | M | CGL | 15 | 710 | 640 | 830 | 455 | 35.4 | 1.83 | 1 | 12.9 | 11.7 | 0.5 | 18 | 15 | Good | E |
| | 26 | M | CAL | 15 | 710 | 640 | 830 | 453 | 35.5 | 1.84 | 1 | 12.8 | 11.7 | 0.4 | 20 | 20 | — | E |
| | 27 | M | CGL | 5 | 710 | 640 | 830 | 447 | 36.2 | 1.76 | 2 | 11.7 | 10.6 | 0.1 | 38 | −15 | Good | C |
| | 28 | N | CGL | 15 | 710 | 640 | 830 | 451 | 36.0 | 1.85 | 0 | 12.6 | 11.6 | 0.8 | 22 | 10 | Good | E |
| | 29 | N | CGL | 15 | 800 | 640 | 830 | 442 | 36.6 | 1.75 | 2 | 12.1 | 11.0 | 0 | 100 | −10 | Good | C |
| | 30 | O | CGL | 15 | 710 | 640 | 830 | 466 | 32.1 | 1.54 | 3 | 12.7 | 11.5 | 1.6 | 88 | −25 | Bad | C |
| | 31 | O | CAL | 15 | 710 | 640 | 830 | 468 | 32.2 | 1.55 | 4 | 12.8 | 11.6 | 1.4 | 74 | −20 | — | C |
| | 32 | P | CGL | 15 | 710 | 640 | 830 | 470 | 31.6 | 1.62 | 0 | 10.8 | 10.6 | 0.7 | 68 | −25 | Bad | C |
| | 33 | Q | CGL | 15 | 710 | 640 | 830 | 458 | 33.0 | 1.68 | 16 | 11.9 | 11.2 | 0.3 | 32 | −20 | Good | C |

E: Example
C: Comparative example

Embodiment 2

The Embodiment 2-1 is a steel sheet which consists essentially of: 0.004 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, by mass %, and balance of substantially Fe; the Nb content satisfies eq. (1), $$(12/93)\times Nb^*/C \geqq 1.0 \quad (1)$$

where, $Nb^*=Nb-(93/14)\times N$, and where, C, N, and Nb designate the content of respective elements, (mass %); and yield strength and average grain size of the ferritic grains satisfy eq. (2), $$YP \leqq -120\times d+1280 \quad (2)$$

Where, YP designates the yield strength [MPa], and d designates the average size of ferritic grains [μm].

The Embodiment 2-1 was derived through the extensive studies on the technology to improve the resistance to secondary working brittleness without applying prior art, based on the judgement that conventional IF steels substantially have limitations on satisfying requirements of surface quality, non-aging property, workability, and resistance to secondary working brittleness, at a time. As a result, the inventors of the present invention found that high strength steel sheets that simultaneously satisfy the above-described characteristic requirements are attained by controlling the contents of C, N, and Nb, and the relation therebetween in a specified range, and further by refining the grain sizes.

The detail of the specific range described above is given below.

C: 0.0040 to 0.02%

Carbon is an important element in the present invention, and C is necessary to be added to 0.0040% or more to secure satisfactory tensile strength. If, however, C content exceeds 0.02%, the ductility significantly decreases. Therefore, the C content is specified to a range of from 0.0040 to 0.02%. Since the above-described characteristics vary depending on the value of Nb/C (ration of atomic equivalent), the control of Nb/C, described below, is required. A more preferable range of C content is from 0.005 to 0.008%.

Si: 1.0% or Less

Silicon is an effective element to secure strength. If, however, the Si content exceeds 1.0%, the surface property and the coating adhesiveness significantly degrade. Thus, the Si content is specified to 1.0% or less.

Mn: 0.7 to 3.0%

Manganese is an effective element to prevent the generation of slab hot-cracking by precipitating S in steel as MnS and to increase the strength without degrading the coating adhesiveness. To assure a specific tensile strength, the Mn content is necessary to be 7% or more. If, however, the Mn content exceeds 3.0%, the slab cost significantly increases, and the $\alpha/\gamma$ transformation temperature decreases to limit the range of annealing temperatures, thus degrading workability. Therefore, the Mn content is specified to a range of from 0.7 to 3.0%.

P: 0.15% or Less

Phosphorus is an effective element to secure strength, and is required to be added to 0.02% or more. On the other hand, if the P content exceeds 0.15%, the alloying treatability of zinc plating degrades. Consequently, the P content is specified to 0.15% or less.

S: 0.02% or Less

Sulfur degrades the hot-workability to enhance the sensitivity to hot-cracking of slab. If the S content exceeds 0.02%, fine MnS precipitates to degrade the workability. Therefore, the S content is specified to 0.02% or less.

Al: 0.01 to 0.1%

Aluminum is added to precipitate N in steel as AlN and to minimize the residual solid solution N. The effect is not sufficient with the Al content of less than 0.01%. And, above 0.1% of Al content does not give high effect for the added value. Therefore, the Al content is specified to a range of from 0.01 to 0.1%.

N: 0.004% or Less

Nitrogen is precipitated in a form of AlN, and is detoxified. To detoxify N to the maximum level even at the above-given minimum content of Al, the N content is specified to 0.004% or less.

Nb: 0.2% or Less

Niobium is an important element, similar with C, in the present invention, and significantly contributes to the improvement of resistance to secondary working brittleness, non-aging property, and workability by fixing the solid solution C and by refining grain sizes, as described below. Excess amount of Nb addition, however, induces degradation of ductility. Therefore, the Nb content is specified to 0.2% or less. A more preferable range of Nb content is from 0.08 to 0.14%.

Relation Between Nb and C, N: $(12/94)\times Nb^*/C \geqq 1.0$, $Nb^*=Nb-(93/14)\times N$ The inventors of the present invention conducted investigation on steels focusing on the relation between Nb and C, N, from the viewpoint of non-aging property and on workability, and found that these characteristics significantly depend on the value of Nb* (effective Nb amount) determined by subtracting a value of Nb chemically equivalent with N from the Nb amount. The Nb* is expressed by the following formula.

$$Nb^*=Nb-(93/14)\times N$$

Further investigation derived that the ratio of Nb* to C amount, Nb*/C, gives influence on the non-aging property and the workability. Particularly for the non-aging property, if the value of Nb*/C becomes less than 1 of chemical equivalent, a yield point elongation (YPEl) appears by aging at normal temperature for a long period, as described below. Also the r value which is an index for workability similarly decreases significantly when the Nb*/C becomes less than 1 of chemical equivalent. Consequently, the relation between Nb and C, N is defined by eq. (1), $$(12/93)\times Nb^*/C \geqq 1.0 \quad (1)$$

where, $Nb^*=Nb-(93/14)\times N$

Furthermore, the inventors of the present invention conducted an investigation on steels focusing on the relation between the metallic structure and the material, in view of the resistance to secondary working brittleness, and found that the ferritic grain size d [μm] and the yield point strength YP [MPa] are the characteristics that significantly affect on the resistance to secondary working brittleness. The investigation confirmed that the resistance to secondary working brittleness drastically increases by adequately controlling the value of weighed sum of these characteristics, [YP+120×d], to a specific level or smaller. Consequently, the relation between the ferritic grain size and the yield strength is specified to eq. (2), as described below, $$YP \leqq -120\times d+1280 \quad (2)$$

where, YP designates the yield strength [MPa] and d designates the ferritic grain average size [μm].

With the above-described findings, a high strength steel sheet having excellent non-aging property, workability, and resistance to secondary working brittleness, and applicable to body exterior sheets of automobiles by controlling the compositions within the specified range of the present invention and by satisfying the above-given equations (1) and (2). Furthermore, the high strength zinc-base sheetd steel sheet according to the present invention assure about 30 MPa of strength through the strengthening of NbC dispersion and precipitation, so that the necessary adding amount of solid solution strengthening elements such as Si and P can be reduced, thus providing excellent surface quality.

The Embodiment 2-2 is a steel sheet that is a modification of the steel of the Embodiment 2-1, having a chemical composition consisting essentially of: 0.0040 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, 0.05% or less Ti, by mass %, and balance of substantially Fe.

The steel of the Embodiment 2-2 is a steel of the Embodiment 2-1 further adding Ti to improve the quality and the resistance to secondary working brittleness. Titanium improves the workability by forming a carbo-nitride to refine the structure of hot-rolled sheet. If, however, the Ti content exceeds 0.05%, the precipitate becomes coarse, and sufficient effect cannot be attained. Therefore, the Ti content is specified to 0.05% or less.

The Embodiment 2-3 is a steel sheet that is a modification of the steel of the Embodiment 2-1, having a chemical composition consisting essentially of: 0.0040 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, 0.002% or less B, by mass %, and balance of substantially Fe.

The steel of the Embodiment 2-3 is a steel of the Embodiment 2-1 further adding B to improve the quality and the resistance to secondary working brittleness. Boron is added to strength the grain boundaries and to improve the resistance to secondary working brittleness. If, however, the B content exceeds 0.002%, the formability significantly degrades. Therefore, the B content is specified to 0.002% or less.

The Embodiment 2-4 is a steel sheet that is a modification of the steel of the Embodiment 2-1, having a chemical composition consisting essentially of: 0.0040 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, 0.05% or less Ti, 0.002% or less B, by mass %, and balance of substantially Fe.

The steel of the Embodiment 2-4 is a steel of the Embodiment 2-1 further adding Ti and B to improve the quality and the resistance to secondary working brittleness. Titanium improves the workability by forming a carbo-nitride to refine the structure of hot-rolled sheet. Boron strengthens the grain boundaries and improves the resistance to secondary working brittleness. If, however, the Ti content exceeds 0.05%, the precipitate becomes coarse, and sufficient effect cannot be attained. And, if the B content exceeds 0.002%, the formability significantly degrades. Therefore, the Ti content is specified to 0.05% or less, and the B content is specified to 0.002% or less.

The above-described Embodiments 2-1 through 2-4 may use a galvanized steel sheet prepared by applying zinc plating onto the high strength steel sheet according to respective Embodiments. The characteristics of the high strength steel sheet are not degraded by the treatment of zinc plating, and the excellent resistance to secondary working brittleness is secured.

The Embodiment 2-5 is a method for manufacturing a high strength steel sheet, which method comprises the steps of: hot-rolling a slab having an above-described composition at finish temperatures of Ar3 transformation point or above; coiling the hot-rolled steel sheet at temperatures of from 500 to 700° C.; cold-rolling and annealing the coiled hot-rolled steel sheet or cold-rolling, annealing, and zinc-base plating the coiled hot-rolled steel sheet.

The hot-rolling is carried out at finish temperatures of $Ar_3$ transformation point or above because the rolling at below $Ar_3$ point degrades the workability of finished product. The coiling is carried out at temperatures of from 500 to 700° C. because the temperatures of 500° C. or above are necessary to fully precipitate NbC and because the temperatures of 700° C. or below are necessary to prevent occurrence of dents on the steel surface caused from peeled scale.

Hot-rolling of a slab can be done either after heating in a reheating furnace or directly without heating. The conditions of cold-rolling, annealing, and zinc plating are not specifically limited, and normally applied conditions can attain the wanted effect.

The Embodiment 2-6 is a method for manufacturing a high strength zinc-base sheetd steel sheet, which method containing each step of the Embodiment 2-5 and the step of zinc-base plating on the annealed steel sheet.

The Embodiment 2-6 provides the target effect on not only a hot dip zinc-base sheetd steel sheet but also an electrolytic zinc-base sheetd steel sheet. The zinc-base sheetd steel sheet according to the present invention may further be applied with an organic coating after the plating.

In these means, the phrase "balance of substantially Fe" means that inevitable impurities and other trace amount elements may be included in the scope of the present invention unless they diminish the action and effect of the present invention.

On implementing the present invention, the zinc sheetd steel sheet may be prepared by manufacturing a cold-rolled steel sheet under an adjustment of chemical composition as described above, then, at need, by applying zinc plating thereon. For a part of the chemical composition, individual characteristics can be improved by the following-given modifications.

Regarding C, the C content is specified to a range of from 0.0050 to 0.0080%, preferably from 0.0050 to 0.0074%, to adequately control the mode of precipitate and of dispersion and further to improve the resistance to secondary working brittleness, thus to attain more preferable performance.

As for Si, the Si content is preferably specified to 0.7% or less to further improve the surface property and the coating adhesiveness.

For Nb, the Nb content is preferably specified to more than 0.035% to adequately control the mode of precipitate and of dispersion and further to improve the resistance to secondary working brittleness. For further improving the resistance to secondary working brittleness and for further improving the total performance, the Nb content is preferably 0.08% or more. However, in view of cost, the upper limit of Nb content is preferably 0.140%. Consequently, the Nb content is specified to above 0.035%, preferably in a range of from 0.080 to 0.140%.

As for the relation between Nb and C, N, the description is given in the following referring to the experimental investigations. According to the experiment, slabs having various kinds of compositions were prepared. These slabs were treated by hot-rolling, pickling, cold-rolling, annealing at 830° C., and temper-rolling to 0.5% of draft percentage. To evaluate r value which is an index of deep drawing performance, and non-aging property, the YPEl recovery after the acceleration test at 100° C. for 1 hour was determined.

FIG. 4 shows the relation between [(121/93)×Nb*/C] and the r value. The figure shows that the range of [(12/93)×Nb*/C]≧1.0 gives 1.75 or higher r values, thus providing excellent workability.

Figure 5:
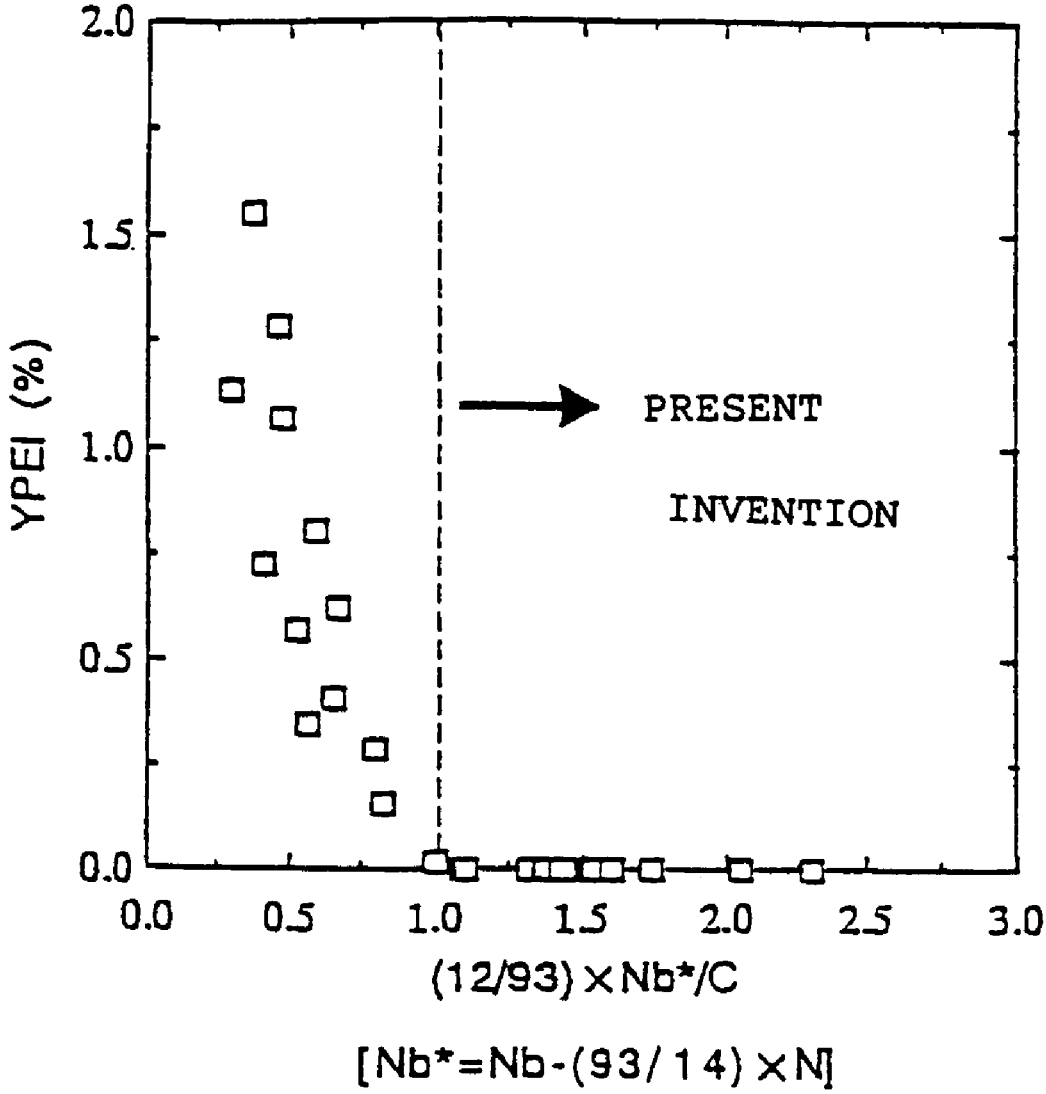
FIG. 5 is a graph showing the relation between (12/93)× Nb*/C and YPEl, relating to the Embodiment 2.

FIG. 5 shows the relation between (121/93)×Nb*/C and YPEl. The figure shows that the range of (12/93)×Nb*/C≧1.0 induces no recovery of WPEl, thus providing excellent non-aging property.

Consequently, [(12/93)×Nb*/C] is defined by eq. (1) given above. According to the present invention, it is preferable to limit the value of [(12/93)×Nb*/C] within a range of from 1.3 to 2.2 from the standpoint of material and cost balance.

The inventors of the present invention conducted experimental investigations also on the relation between the metal structure and the material. According to the experiment, the transition temperature of secondary working brittleness was determined using the specimens prepared in a similar procedure with the above-described experiments. The term "transition temperature of secondary working brittleness" designates the temperature that a material after deep drawing treatment becomes brittle during the secondary working.

According to the experiment, a blank having 100 mm in diameter was punched from a steel sheet, which blank was treated by deep drawing, and cut at edge to make the cup height 30 mm. Then, the cup was immersed in a cooling medium such as ethyl alcohol each at different temperatures to determine the temperature that the fracture mode of the cup transfers from the ductile fracture to the brittle fracture. The temperature is defined as the transition temperature of secondary working brittleness.

Figure 6:
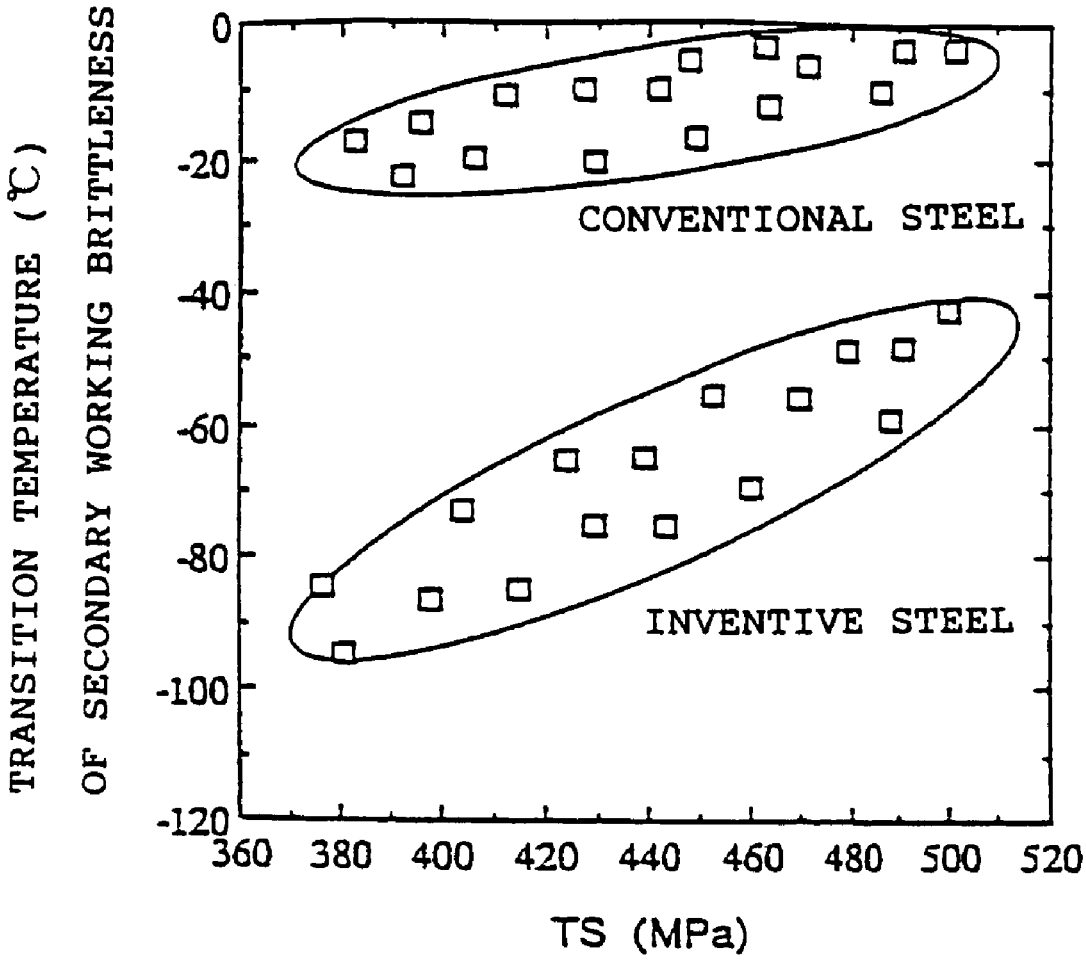
FIG. 6 is a graph showing the relation between the tensile strength TS and the secondary working brittleness transition temperature, relating to the Embodiment 2.

FIG. 6 shows the relation between the tensile strength TS and the transition temperature of secondary working brittleness. The figure derived a finding that, under comparison with same level of strength, the steel according to the present invention, satisfying eq. (2), shows superior resistance to secondary working brittleness to the conventional steels. Main reason that the steel according to the present invention shows superior resistance to secondary working brittleness is presumably that, under comparison with same level of strength, the steel according to the present invention, satisfying eq. (2), has fine grains.

According to an observation under an electron microscope, the steel according to the present invention contains fine and uniformly distributed NbC in grain, and has very few precipitates in the vicinity of grain boundary, or a microscopic structure presumably what is called a precipitate free zone (PFZ) is formed. The existence of PFZ which is readily plastic-deforming at near the grain boundary may also contribute to the improved resistance to secondary working brittleness.

Furthermore, the steel according to the present invention has high n value in a low strain region of from 1 to 10%, thus the deformation at a portion contacting with the punch bottom during drawing increases, and the volume of inflow during the deep drawing decreases, which may reduce the degree of compression working during the shrinking flange deformation. The feature also supposedly contributes to the improvement of resistance to secondary working brittleness.

In the Embodiment 2-1, to further improve the resistance to secondary working brittleness, it is more preferable to establish a condition of eq. (2) to eq. (2'), $$YP \leqq -120 \times d + 1240 \quad (2')$$

where, YP is the yield strength [MPa] and d is the ferritic grain average size [μm].

Also in the Embodiment 2-2, particularly from the view point of surface property of the hot dip galvanizing, the upper limit of Ti content is preferably less than 0.02%, and to attain necessary grain refinement effect, the lower limit thereof is preferably 0.005%.

Also in the Embodiment 2-3, very strong resistance to secondary working brittleness is given, so that, considering that the grains are refined, the B content is preferably in a range of from 0.0001 to 0.001% to suppress the degradation of formability as far as possible.

Also in the Embodiment 2-4, it is preferable to specify the Ti content to a range of from 0.005 to 0.02% and the B content from 0.0001 to 0.001% to assure the grain refinement effect and the formability.

Also in the method for manufacturing high strength steel sheet in the Embodiment 2-5 and the Embodiment 2-6, the above-described effects can be obtained by controlling the chemical composition thereof to above-described preferred range of the Embodiments 2-1 through 2-4.

The high strength steel sheet according to the present invention completely fixes the solid solution C and N by satisfying the above-given eq. (1). Accordingly, the BH value (baking and hardening property) is less than 2 kgf/mm$^2$, thus the material degradation owing to high temperature aging is less. Therefore, aging does not become a problem even when the steel is exposed during summer, or at a relatively high ambient temperature, for a long period. Furthermore, the steel sheet has excellent workability at welded portions, and the sheet is applicable to new technologies such as tailored blank.

EXAMPLES

Steels of Nos. 1 through 23 each having respective chemical compositions given in Table 4 were prepared by melting process, which were then treated by continuous casting to obtain slabs. Each of the slabs was heated to 1,200° C., and hot-rolled at finish temperatures of from 890 to 940° C. to prepare a hot-rolled steel sheet. The hot-rolled steel sheet was treated by pickling, then by cold-rolled at cold-rolling draft percentages (or total draft percentages) of from 50 to 85%, and by continuous annealing. To a part of the annealed steel sheets, a hot dip galvanizing (annealing temperatures of from 800 to 840° C.) was applied. For the hot dip galvanizing after the continuous annealing, the hot dip galvanizing was given at 460° C. after the annealing, then immediately treated by alloying of the coating layer at 500° C. using an in-line alloying furnace.

After that, for the continuously annealed steel sheet and the galvanized steel sheet, temper rolling at 0.7% of draft percentage was applied. The mechanical properties, the grain sizes, and the surface property of these steel sheets were determined. Furthermore, the above-described method was applied to conduct the longitudinal crack test to evaluate the Tc value (transition temperature of secondary working brittleness). Table 5 shows the results of investigations and tests.

The Example steels Nos. 1 through 10 according to the present invention were non-aging and had excellent surface property, and, compared with the Comparative Example steels having the similar strength level, showed extremely superior transition temperature of secondary working brittleness and very good mechanical test values. The steels according to the present invention became high strength steel sheets that had, as expected, high surface quality, non-aging property, and workability applicable to external panels of automobiles, and further showed excellent resistance to secondary brittleness, thus providing extremely high total performance.

To the contrary, the Comparative Example steels Nos. 11 through 23 were inferior to the Example steels of the present invention in terms of at least one characteristics of the mechanical test values, the non-aging property, the transition temperature of secondary working brittleness, and the surface property. For example, Nos. 14, 15, and 17 through 23 contained larger amount of Si, Ti, or sum of them than the specified range of the present invention, so that, particularly for the zinc-base sheetd steel sheets, the surface property significantly degraded. All the Comparative Example steels except for Nos. 12, 16, and 19 showed extremely high transition temperature of secondary working brittleness so that they are not suitable for the materials subjected to secondary working. The steels Nos. 12 and 16 gave small Nb*/C values so that the mechanical test values (non-aging property) are insufficient.

TABLE 4

| No. | C | Si | Mn | P | S | sol.Al | N | Nb | Ti | B | (12 × Nb*)/(93 × C) | Remark |
|---|---|---|---|---|---|---|---|---|---|---|---|---|
| 1 | 0.0045 | 0.01 | 1.10 | 0.051 | 0.007 | 0.039 | 0.0021 | 0.049 | — | — | 1.01 | Example |
| 2 | 0.0051 | 0.21 | 1.03 | 0.029 | 0.011 | 0.042 | 0.0022 | 0.069 | — | — | 1.38 | Example |
| 3 | 0.0049 | 0.02 | 1.05 | 0.051 | 0.008 | 0.045 | 0.0024 | 0.082 | 0.014 | 0.0007 | 1.74 | Example |
| 4 | 0.0050 | 0.01 | 1.08 | 0.052 | 0.009 | 0.042 | 0.0019 | 0.102 | — | — | 2.31 | Example |
| 5 | 0.0071 | 0.01 | 1.95 | 0.075 | 0.012 | 0.044 | 0.0021 | 0.075 | — | — | 1.11 | Example |
| 6 | 0.0067 | 0.02 | 1.92 | 0.079 | 0.013 | 0.049 | 0.0024 | 0.099 | 0.012 | — | 1.60 | Example |
| 7 | 0.0069 | 0.01 | 1.98 | 0.074 | 0.010 | 0.049 | 0.0025 | 0.126 | — | 0.0009 | 2.05 | Example |
| 8 | 0.0070 | 0.26 | 2.27 | 0.035 | 0.007 | 0.041 | 0.0018 | 0.095 | — | — | 1.53 | Example |
| 9 | 0.0125 | 0.03 | 2.61 | 0.079 | 0.015 | 0.042 | 0.0031 | 0.165 | — | — | 1.52 | Example |
| 10 | 0.0121 | 0.35 | 2.51 | 0.042 | 0.007 | 0.039 | 0.0022 | 0.149 | — | — | 1.43 | Example |
| 11 | 0.0021* | 0.01 | 1.48 | 0.064 | 0.006 | 0.045 | 0.0027 | 0.024 | — | — | 0.37* | Comparative example |
| 12 | 0.0057 | 0.02 | 1.28 | 0.075 | 0.008 | 0.044 | 0.0023 | 0.039 | — | — | 0.54* | Comparative example |
| 13 | 0.0024* | 0.03 | 1.05 | 0.085 | 0.010 | 0.049 | 0.0021 | 0.025 | 0.014 | 0.0004 | 0.59* | Comparative example |
| 14 | 0.0025* | 0.29 | 2.01 | 0.078 | 0.016 | 0.048 | 0.0025 | — | 0.041 | 0.0010 | — | Comparative example |

TABLE 4-continued

| No. | C | Si | Mn | P | S | sol.Al | N | Nb | Ti | B | (12 × Nb*)/(93 × C) | Remark |
|---|---|---|---|---|---|---|---|---|---|---|---|---|
| 15 | 0.0023* | 0.51 | 2.13 | 0.052 | 0.009 | 0.051 | 0.0022 | — | 0.105* | — | — | Comparative example |
| 16 | 0.0069 | 0.02 | 2.04 | 0.082 | 0.007 | 0.049 | 0.0023 | 0.041 | — | — | 0.48* | Comparative example |
| 17 | 0.0065 | 0.02 | 2.10 | 0.079 | 0.011 | 0.057 | 0.0021 | — | 0.075* | — | — | Comparative example |
| 18 | 0.0034* | 0.65 | 1.80 | 0.051 | 0.008 | 0.030 | 0.0019 | 0.011 | 0.026 | 0.0006 | — | Comparative example |
| 19 | 0.0072 | 1.01* | 1.76 | 0.036 | 0.011 | 0.056 | 0.0025 | 0.091 | — | — | 1.33 | Comparative example |
| 20 | 0.0205* | 0.23 | 2.18 | 0.097 | 0.009 | 0.055 | 0.0021 | 0.189 | — | — | 1.10 | Comparative example |
| 21 | 0.0083 | 0.10 | 0.35* | 0.071 | 0.007 | 0.033 | 0.0020 | 0.019 | 0.080* | 0.0005 | 0.09* | Comparative example |
| 21 | 0.0052 | 0.08 | 1.20 | 0.080 | 0.018 | 0.034 | 0.0032 | — | 0.192* | 0.0010 | — | Comparative example |
| 23 | 0.0089 | 1.20* | 1.60 | 0.085 | 0.009 | 0.035 | 0.0028 | — | 0.185* | 0.0018 | — | Comparative example |

TABLE 5

| No. | YP (MPa) | TS (MPa) | YPEI (%) | EI (%) | r value | BH (MPa) | Grain size (μm) | Tc* (° C.) | Surface property | Remark |
|---|---|---|---|---|---|---|---|---|---|---|
| 1 | 262 | 398 | 0.0 | 38.1 | 1.81 | 0.0 | 7.8 | −90 | ⊙ | Example |
| 2 | 261 | 395 | 0.0 | 38.4 | 1.83 | 0.0 | 7.9 | −90 | ⊙ | Example |
| 3 | 258 | 394 | 0.0 | 38.5 | 1.87 | 0.0 | 7.2 | −100 | ⊙ | Example |
| 4 | 256 | 391 | 0.0 | 38.8 | 1.90 | 0.0 | 7.5 | −95 | ⊙ | Example |
| 5 | 277 | 448 | 0.0 | 36.4 | 1.80 | 0.0 | 7.0 | −70 | ⊙ | Example |
| 6 | 272 | 444 | 0.0 | 36.8 | 1.86 | 0.0 | 6.8 | −75 | ⊙ | Example |
| 7 | 269 | 441 | 0.0 | 36.4 | 1.82 | 0.0 | 6.5 | −85 | ⊙ | Example |
| 8 | 273 | 443 | 0.0 | 36.8 | 1.86 | 0.0 | 6.9 | −75 | ⊙ | Example |
| 9 | 312 | 499 | 0.0 | 32.9 | 1.80 | 0.0 | 6.4 | −55 | ⊙ | Example |
| 10 | 315 | 504 | 0.0 | 32.5 | 1.85 | 0.0 | 6.6 | −50 | ⊙ | Example |
| 11 | 269 | 396 | 1.7 | 36.7 | 1.66 | 26.5 | 10.1 | −5 | ⊙ | Comparative example |
| 12 | 277 | 392 | 1.5 | 35.9 | 1.61 | 24.8 | 8.3 | −40 | ⊙ | Comparative example |
| 13 | 275 | 395 | 0.1 | 35.3 | 1.55 | 3.5 | 10.2 | −15 | ⊙ | Comparative example |
| 14 | 309 | 444 | 0.0 | 34.7 | 1.61 | 0.0 | 10.4 | −15 | x | Comparative example |
| 15 | 289 | 442 | 0.0 | 35.1 | 1.68 | 0.0 | 10.9 | 0 | x | Comparative example |
| 16 | 306 | 442 | 1.4 | 33.7 | 1.62 | 22.4 | 8.1 | −35 | ⊙ | Comparative example |
| 17 | 293 | 439 | 0.0 | 35.5 | 1.69 | 0.0 | 10.9 | 0 | x | Comparative example |
| 18 | 302 | 445 | 1.1 | 34.2 | 1.59 | 20.1 | 10.3 | −10 | x | Comparative example |
| 19 | 275 | 444 | 0.0 | 35.6 | 1.73 | 0.0 | 8.3 | −35 | x | Comparative example |
| 20 | 312 | 497 | 0.0 | 30.5 | 1.44 | 0.0 | 9.1 | −10 | x | Comparative example |
| 21 | 243 | 399 | 0.0 | 35.1 | 1.56 | 0.0 | 10.2 | −20 | x | Comparative example |
| 21 | 289 | 475 | 0.0 | 32.2 | 1.62 | 0.0 | 9.6 | −15 | x | Comparative example |
| 23 | 361 | 593 | 0.0 | 25.9 | 1.59 | 0.0 | 9.4 | −10 | x | Comparative example |

Embodiment 3

The Embodiment 3-1 is a steel sheet which consists essentially of: 0.004 to 0.02% C, 1.0% or less Si, 0.7 to 3.0% Mn, 0.02 to 0.15% P, 0.02% or less S, 0.01 to 0.1% sol.Al, 0.004% or less N, 0.01 to 0.2% Nb, by mass %, and balance of substantially Fe; and an n value determined by 10% or lower deformation in a uniaxial tensile test and a ferritic grains average size [μm] satisfy the eq. (11) and eq. (12), respectively, $$n \text{ value} \geqq -0.00029 \times TS + 0.313 \quad (11)$$

$$YP \leqq -120 \times d + 1280 \quad (12)$$

where, TS designates the tensile strength [MPa] and YP designates the yield strength [MPa].

The Embodiment 3-1 was conducted during a detail investigation on the control variables of formability using an example of front fender subjected to forming mainly with stretching. In the stretch-oriented forming, it was found that the deformation was small at a portion contacted with punch bottom, and was concentrated on the punch shoulder at side wall section and on the periphery of die shoulder.

Accordingly, by letting the strain generated in the steel sheet at the portion contacting with the punch bottom increase even to a slight amount, the strain concentration at the punch shoulder at side wall section and at the die shoulder can be relaxed. On that point, there was derived a finding that it is effective to improve the n value in a low strain region, corresponding to the strain generated in the portion contacting with the punch bottom, not to improve the n value in a high strain region conventionally used for evaluating the stretch performance. The investigation showed that the lower limit of n value is necessary to be determined responding to the TS value. Thus, eq. (11) was derived. As an n value at deformations of 10% or less, then value determined by the two-point method, at nominal deformation 1% and 10%, may be applied.

For the external body sheets of automobiles and the like, which request particularly high surface property, the surface property shall be in excellent state after a severe condition forming. To secure high stretch forming performance and to prevent the appearance of rough surface after press-forming, it was found that the grains shall be refined. The investigation revealed that the ferritic grain average size d shall be determined responding to the YP value. Thus eq. (12) was derived.

The reasons to specify the chemical composition of the Embodiment 3-1 are described below.

C: 0.0040 to 0.02% (Mass %, and so Forth)

Carbon forms a carbide with Nb, gives influence on the strength of base material and on the work hardening in a low strain region during panel-forming stage, and increases the strength and improves the formability. If, however, the C content is less than 0.0040%, the effect cannot be attained. And, if the C content exceeds 0.02%, the ductility degrades, though the strength and the high value of n in a low strain region is obtained. Therefore, the C content is specified to a range of from 0.0040 to 0.02%.

Si: 1.0% or Less

Silicon is an effective element to secure strength. If, however, the Si content exceeds 1.0%, the surface property and the coating adhesiveness are significantly degraded. Therefore, the Si content is specified to 1.0% or less.

Mn: 0.7 to 3.0%

Manganese is an effective element to precipitate S in steel as MnS, thus to prevent hot-cracking of slab, and to strengthen the steel without degrading the coating adhesiveness. To precipitate S as MnS to assure the strength, the Mn content is necessary 0.7% or more. If the Mn content exceeds 3.0%, the formability degrades. Therefore, the Mn content is specified to a range of from 0.7 to 3.0%.

P: 0.02 to 0.15%

Phosphorus is an effective element to strengthen steel, and the effect appears at the addition of P by 0.02% or more. However, if the P content exceeds 0.15%, the degradation of alloying treatability of zinc plating is induced. Therefore, the P content is specified to a range of from 0.02 to 0.15%.

S: 0.02% or Less

Sulfur exists in steel in a form of MnS. If the S content exceeds 0.02%, the ductility degrades. Therefore, the S content is specified to 0.02% or Less.

Sol.Al: 0.01 to 0.1%

Aluminum is necessary to be added by 0.01% or more to precipitate N as AlN, and to avoid remaining of solid solution N. If the sol.Al content exceeds 0.1%, the solid solution Al induces degradation in ductility. Therefore, the sol.Al content is specified to a range of from 0.01 to 0.1%.

N: 0.004% or Less

Nitrogen is detoxified by precipitating itself as AlN. However, even the above-described sol.Al content is at the lower limit, the N content is required to be 0.004% or less to precipitate all amount of N as AlN. Therefore, the N content is specified to 0.004% or less.

Nb: 0.01 to 0.2%

Niobium is an important element according to the present invention. By the reduction of solid solution C caused from the formation of NbC and by the increase in the n value in a low strain region owing to an adequate amount of solid solution Nb, the above-given eq. (11) is assured to be satisfied. If, however, the Nb content is less than 0.01%, the effect cannot be obtained. And, if the Nb content exceeds 0.2%, the yield strength increases to reduce the n value in a low strain region and to reduce the ductility. Therefore, the Nb content is specified to a range of from 0.01 to 0.2%.

The Embodiment 3-2 is a steel sheet that is a modification of the steel of the Embodiment 3-1, having a chemical composition consisting essentially of: 0.0040 to 0.02% C, 1.0% or less. Si, 0.7 to 3.0% Mn, 0.02 to 0.15% P, 0.02% or less S, 0.01 to 0.1% sol.Al, 0.004% or less N, 0.01 to 0.2% Nb, 0.05% or less Ti, by mass %, and balance of substantially Fe.

The steel of the Embodiment 3-2 is a steel of the Embodiment 3-1 further adding Ti to refine the structure of hot-rolled sheet. Titanium forms a carbo-nitride to refine the structure of hot-rolled sheet, thus improves the formability. If, however, the Ti content exceeds 0.05 wt. %, the precipitate becomes coarse, and sufficient effect cannot be attained. Therefore, the Ti content is specified to 0.05% or less.

The Embodiment 3-3 is a steel sheet that is a modification of the steel of the Embodiment 3-1, having a chemical composition consisting essentially of: 0.0040 to 0.02% C, 1.0% or less Si, 0.7 to 3.0% Mn, 0.02 to 0.15% P, 0.02% or less S, 0.01 to 0.1% sol.Al, 0.004% or less N, 0.01 to 0.2% Nb, 0.002% or less B, by mass %, and balance of substantially Fe.

The steel of the Embodiment 3-3 is a steel of the Embodiment 3-1 further adding B to improve the resistance to secondary working brittleness. Boron is added to strength the grain boundaries. If, however, the B content exceeds 0.002 wt. %, the formability significantly degrades. Therefore, the B content is specified to 0.002% or less.

The Embodiment 3-4 is a steel sheet that is a modification of the steel of the Embodiment 3-1, having a chemical composition consisting essentially of: 0.0040 to 0.02% C, 1.0% or less Si, 0.7 to 3.0% Mn, 0.02 to 0.15% P, 0.02% or less S, 0.01 to 0.1% sol.Al, 0.004% or less N, 0.01 to 0.2% Nb, 0.05% or less Ti, 0.002% or less B, by mass %, and balance of substantially Fe.

The steel of the Embodiment 3-4 is a steel of the Embodiment 3-1 further adding Ti and B to improve the formability and the resistance to secondary working brittleness. Titanium improves the formability by forming a carbo-nitride to refine the structure of hot-rolled sheet. Boron strengthens the grain boundaries and improves the resistance to secondary working brittleness. If, however, the Ti content exceeds 0.05%, the precipitate becomes coarse. And, if the B content exceeds 0.002%, the formability significantly degrades. Therefore, the Ti content is specified to 0.05% or less, and the B content is specified to the upper limit of 0.05% and the lower limit of 0.002%.

The Embodiment 3-5 is a high strength steel sheet of the Embodiments 3-1 through 3-4 further adding one or more of the element selected from the group consisting of: 1.0% or less Cr, 1.0% or less Mo, 1.0% or less Ni, and 1.0% or less Cu, by mass %.

The Embodiment 3-5 further adding one or more of the elements selected from the group consisting of Cr, Mn, Ni, and Cu, to the chemical composition of the above-described one according to the present invention, to provide the steel sheet with higher strength. The following is the description of the reasons to specify the content of individual elements.

Cr: 1.0% or Less

Chromium is added to increase the strength. If, however, the Cr content exceeds 1.0%, the formability degrades. Therefore, the upper limit of the Cr content is specified to 1.0%.

Mo: 1.0% or Less

Molybdenum is an effective element to secure strength. If, however, the Mo content exceeds 1.0%, the recrystallization in the r region (autstenitic region) is delayed during hot-rolling, thus increases the rolling load. Therefore, the upper limit of the Mo content is specified to 1.0%.

Ni: 1.0% or Less

Nickel is added as an element to strengthen the solid solution. If, however, the Ni content exceeds 1.0%, the transformation point significantly lowers to likely induce the appearance of low temperature transformation phase during hot-rolling. Therefore, the upper limit of the Ni content is specified to 1.0%.

Cu: 1.0% or Less

Copper is an effective element to strengthen solid solution. If, however, the Cu content exceeds 1.0%, surface defects likely occur by forming a low melting point phase during hot-rolling. Therefore, the Cu content is specified to 1.0% or less. Copper is preferably added together with Ni.

The Embodiment 3-6 is a high strength zinc-base sheetd steel sheet prepared by applying a zinc-base plating on the surface of the steel sheet of either one of the steel sheets of Embodiment 3-1 through the Embodiment 3-5.

The Embodiment 3-6 provides the corrosion resistance to the steel by further applying a zinc-base plating on the surface of the above-described steel sheet according to the present invention. The method of plating is not specifically limited, and the method may be hot dip galvanizing, electrolytic plating, and the like.

In these means, the phrase "balance of substantially Fe" means that inevitable impurities and other trace amount elements may be included in the scope of the present invention unless they diminish the action and effect of the present invention.

On implementing the present invention, adjustment of chemical composition may be given as described above. For a part of the chemical composition, individual characteristics can be improved by the following-given modifications.

Regarding C, the C content is specified to a range of from 0.0050 to 0.0080%, preferably from 0.0050 to 0.0074%, to adequately control the mode of precipitate and of dispersion and further to improve the resistance to secondary working brittleness, thus to attain more preferable performance.

As for Si, the Si content is preferably specified to 0.7% or less to further improve the surface property and the coating adhesiveness.

For Nb, the Nb content is preferably specified to more than 0.035% further increase the n value in a low strain region. For further improving the formability and total performance, the Nb content is preferably 0.08%,or more. However, in view of cost, the upper limit of Nb content is preferably 0.14%.

The reason that Nb increases the n value in a low strain region is not fully analyzed. A detail observation under an electron microscope revealed the following-described assumption. When the Nb and C contents are adequately controlled, large amount of NbC precipitate in grains, and a precipitate free zone (PFZ), where no precipitate exists, appear in the vicinity of grains. Since PFZ is free from precipitate, the strength of the portion is lower than that inside of grain, thus the portion is able to be plastic-deformed at a low stress level. As a result, a high n value is attained in a low strain region. To do this, the control of atomic equivalent ratio of Nb to C to an adequate value is effective. Through an extensive study of the inventors of the present invention, it was found that, to obtain that type of preferable precipitate mode according to the present invention, the control of Nb/C (atomic equivalent ration) in a range of from 1.3 to 2.5 is more preferable to increase the n value.

As described above, the high strength cold-rolled steel sheet according to the present invention contains not large amount of special elements such as Cr, and is manufactured by a general process, as described below, so that the steel sheet is inexpensive. Furthermore, the steel according to the present invention is excellent in terms of weldability and of resistance to secondary working brittleness because the steel refines the grains by NbC precipitation.

When Ti is added, the Ti content is specified to less than 0.02% from the point of surface property of hot dip galvanizing. To obtain necessary grain refinement effect, 0.005% or more is preferable.

As for B, since the steel according to the present invention shows excellent resistance to secondary working brittleness without adding B, as described above, when B is added, it is preferred to limit the B content to a range of from 0.0001 to 0.001% to minimize the degradation of formability.

Regarding the manufacturing method, an applicable method is an ordinary one to prepare a steel having an adjusted composition, by melting, then to form a slab by applying continuous casting, then by hot-rolling the slab after reheating or directly without reheating to obtain a hot-rolled steel sheet. After pickling the hot-rolled steel sheet, annealing is applied to obtain a cold-rolled steel sheet.

Furthermore, at need, the surface of the steel sheet may be coated by zinc-base plating including electric galvanizing and hot dip galvanizing. The obtained press-formability is similar to that of cold-rolled steel sheets. Zinc-base plating includes alloying galvanizing, zinc-Ni alloy plating. An organic coating treatment may further be applied after the plating.

Alternative manufacturing methods may be applied. For example, the hot-rolling condition includes the finish rolling at temperatures of from Ar3 transformation point to 960° C. from the viewpoint of surface quality and homogeneity of material. From the standpoint of descaling performance in pickling and material stability, the hot-rolled steel sheet is preferably coiled at temperatures of 680° C. or below. As for the coiling temperature after hot-rolling, when continuous annealing (CAL or CGL) is applied after cold-rolling, the coiling temperature is preferably 600° C. or above, and when box annealing (BAF) is applied, the coiling temperature is preferably 540° C. or above. To assure the hot-rolling finish temperature during manufacturing a thin sheet, the sheet bar may be heated by a bar heater during hot-rolling.

On descaling the surface of a hot-rolled steel sheet, to provide excellent adaptability to exterior body sheet for automobiles, it is preferred to fully remove not only the primary scale but also the secondary scale formed during hot rolling step. On conducting cold-rolling after descaling, to provide the hot-rolled steel sheet with a deep drawing performance necessary to exterior body sheet for automobile, the cold-draft percentage is preferably 50% or more.

As for the annealing temperature, when the continuous annealing is applied to a cold-rolled steel sheet, a preferred temperature range is from 780 to 880° C., and when the box annealing is applied, a range of from 680 to 750° C. is preferable.

Figure 7:
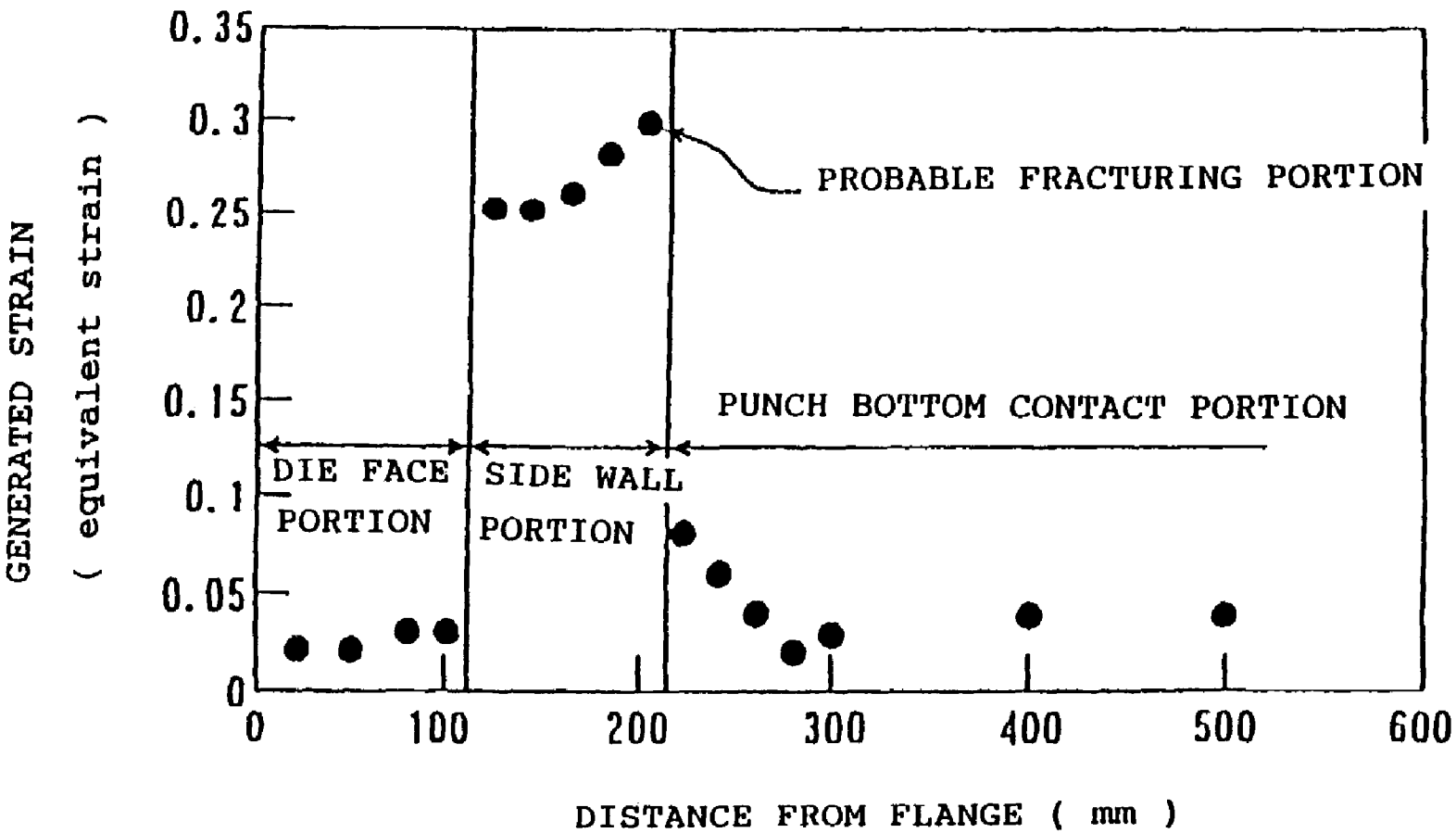
FIG. 7 is a graph showing an example of equivalent strain distribution in the vicinity of probable-fracturing section in an actual scale front fender model formed component, relating to the Embodiment 3.
Figure 8:
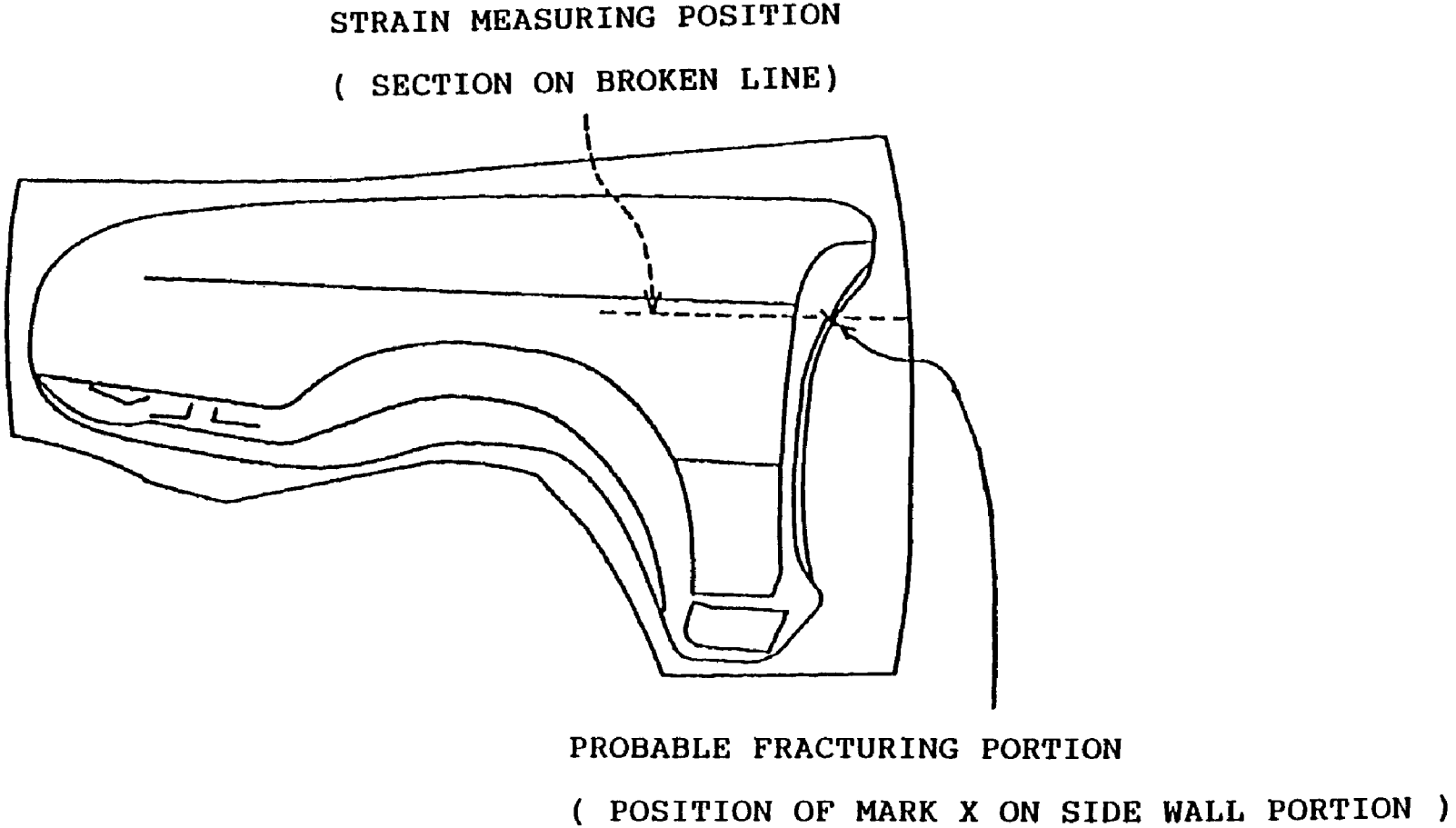
FIG. 8 illustrates a general view of an actual scale front fender model formed component, relating to the Embodiment 3.

The following is detail description on the tensile characteristics and the composition, which are specified in the steel sheet according to the present invention. FIG. 7 is a graph showing an example of equivalent strain distribution in the vicinity of probable-fracturing section in an actual scale front fender model formed component. FIG. 8 illustrates a general view of the front fender model formed component.

FIG. 7 shows that the generated strain at near the punch shoulder on side wall section and the die shoulder increased to around 0.3, and that at the punch bottom portion was low around 0.1.

Accordingly, by letting the strain generated in the steel sheet at the portion contacting with the punch bottom increase even to a slight amount, the strain concentration at the punch shoulder at side wall section and at the die shoulder can be relaxed to prevent the fracture at these portions. On that point, there was derived a finding that it is effective to let the n value in a low strain region not higher than 10% satisfying the above-given eq. (11) relating to the value of TS [MPa]. Then value is the one determined by the two-point method, at nominal deformation 1% and 10%.

As for the prevention of occurrence of rough surface after press-forming, to attain further excellent surface property in the present invention, it is more preferable that the yield strength YP [MPa] and the ferritic grain average size d [μm] satisfy. eq. (12') instead of eq. (12).

$$YP \leqq -120 \times d + 1240 \quad (12')$$

Example 1

With the steels having chemical compositions listed in Table 6, the following-given tests were conducted. After melting to prepare the steels Nos. 1 through 13, continuous casting was applied to prepare respective slabs. Each of the slabs was heated to 1,200° C., then was hot-rolled to prepare a hot-rolled steel sheet, under the conditions of finish temperatures of from 880 to 940° C., coiling temperatures of from 540 to 560° C. (for box annealing) or 600 to 660° C. (for continuous annealing, continuous annealing+hot dip galvanization), and was subjected to pickling and cold-rolling with draft percentages of from 50 to 85%.

After that, either one of the continuous annealing (annealing temperatures of from 800 to 840° C.), the box annealing (annealing temperatures of from 680 to 750° C.), and the continuous annealing+hot dip galvanization (annealing temperatures of from 800 to 840° C.). In the continuous annealing+hot dip galvanization, the hot dip galvanizing was given at 460° C. after the annealing, followed by immediately alloying treatment of the coating layer at 500° C. in an in-line alloying treatment furnace. For the steel sheet treated by annealing or annealing+hot dip galvanizing, temper rolling at draft percentage of 0.7% was applied.

The mechanical properties and the grain sizes of these steel sheets were determined. These steel sheets were applied to press-forming to obtain front fenders, with which the critical fracture cushion force was determined, and the generation of rough surface after the press-forming was also observed.

Furthermore, the transition temperature of secondary working brittleness was determined. A blank having 100 mm in diameter was punched from a steel sheet, which blank was treated by deep drawing (drawing ratio of 2.0) as the primary working, and cut at edge to make the cup height 30 mm. Then, the cup was immersed in a cooling medium such as ethyl alcohol each at a constant temperature, and a conical punch was applied to expand the cup edge portion as the secondary working, thus determined the temperature that the fracture mode of the cup transfers from the ductile fracture to the brittle fracture. The temperature is defined as the transition temperature of secondary working brittleness. The test results are shown in Table 7.

The symbols appeared in Table 11 specify the following.

N value: the value at 1 and 10% strains

CAL: Continuous annealing

BAF: Box annealing

CGL: Continuous annealing+hot dip galvanization

Example steel sheets Nos. 1 through 6 according to the present invention gave high critical fracture cushion force of 65 ton or more, and showed excellent stretch performance. To the contrary, the Comparative Example materials Nos. 9 and 10 had less n values, as low as below 0.18, in low strain regions of from 1 to 10%, thus generated fractures at a small cushion force of 50 ton or less, though the n value in conventional strain regions of from 10 to 20% gave high values of 0.23 or more. The Comparative Example materials Nos. 10, 11, and 13 through 12, (steel Nos. 8, 9,and 11 through 13), contained excessive amount of Ti (also Si in Steel No. 8) so that the surface property significantly degraded.

The steels according to the present invention gave −65° C. or below of longitudinal crack transition temperature for all the levels tested, and showed very strong resistance to secondary working brittleness. In addition, since the steels according to the present invention had refined grains, no rough surface appeared after press-forming. Furthermore, the steels according to the present invention were confirmed to have excellent surface property after hot dip plaiting and excellent workability and fatigue characteristics at welded portions.

Figure 9:
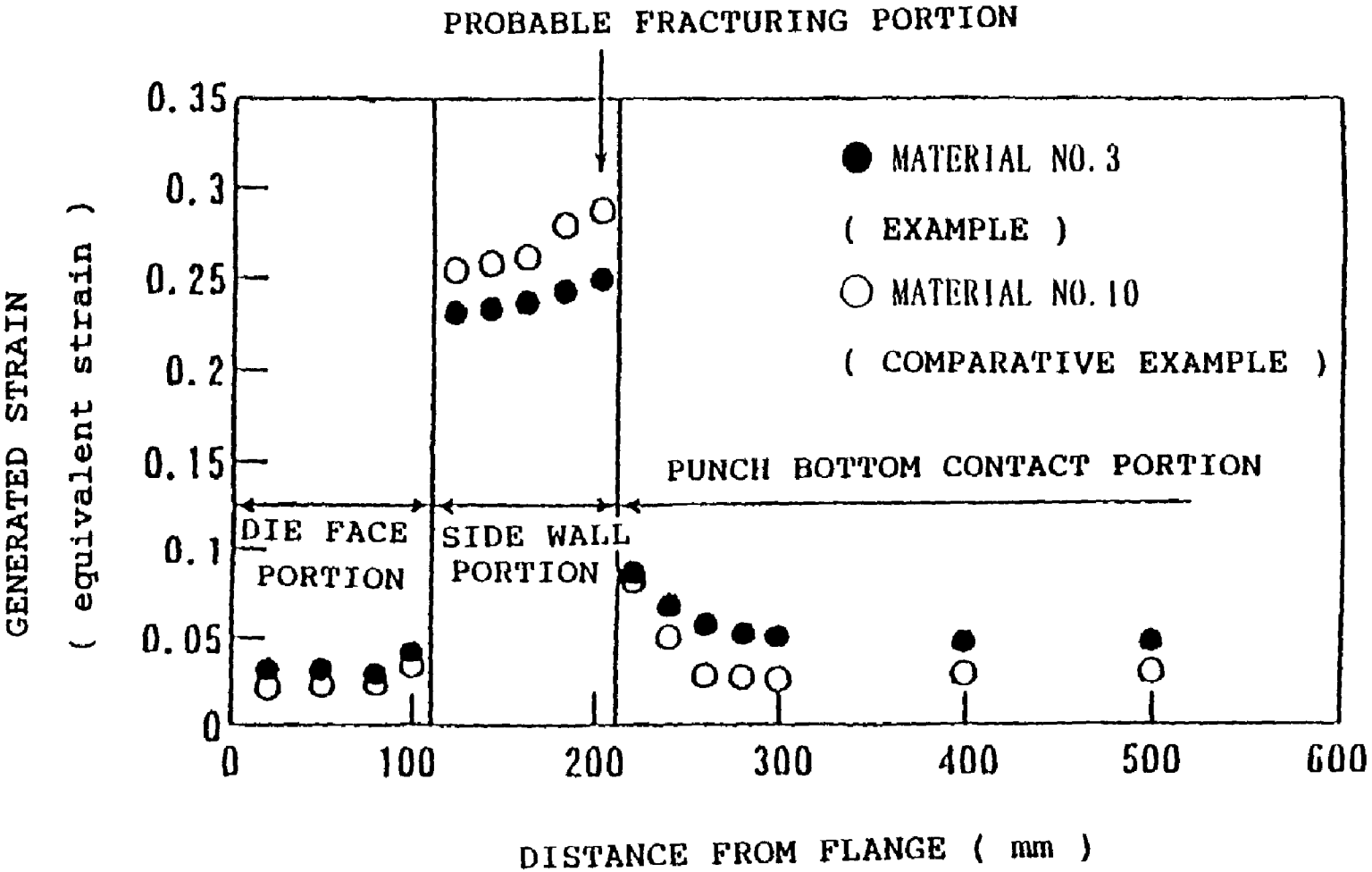
FIG. 9 is a graph showing the strain distribution in the vicinity of probable-fracturing section in the case of front fender model formation, relating to the Embodiment 3.

A model forming test was given to the steel No. 3 (Example according to the present invention) and to the steel No. 10 (Comparative Example) listed in Table 7. The test was given to determine the strain distribution in the vicinity of probable fracture section in the case of forming the front fender model shown in FIG. 8 under a condition of 40 ton of the cushion force. The result is given in FIG. 9.

Compared with the Comparative Example (No. 10, ○ mark), the Example according to the present invention (No. 3, ● mark) gave large generated strain at the punch bottom portion, and the strain generation at the side wall section was suppressed. Thus, the steel sheets according to the present invention is concluded to be advantageous against fracture.

TABLE 6

| Steel No. | C | Si | Mn | P | S | sol.Al | N | Nb | Ti | B | Other | Remark |
|---|---|---|---|---|---|---|---|---|---|---|---|---|
| 1 | 0.0055 | 0.01 | 1.05 | 0.052 | 0.006 | 0.042 | 0.0024 | 0.069 | — | — | — | Example |
| 2 | 0.0069 | 0.25 | 1.95 | 0.045 | 0.007 | 0.040 | 0.0018 | 0.099 | — | — | — | Example |
| 3 | 0.0065 | 0.02 | 1.98 | 0.076 | 0.008 | 0.045 | 0.0025 | 0.088 | — | — | Cr: 0.35 | Example |
| 4 | 0.0093 | 0.13 | 2.01 | 0.050 | 0.011 | 0.038 | 0.0019 | 0.139 | 0.011 | 0.0004 | — | Example |
| 5 | 0.0065 | 0.26 | 2.33 | 0.077 | 0.009 | 0.041 | 0.0029 | 0.128 | 0.015 | — | Cu: 0.40, Ni: 0.30 | Example |
| 6 | 0.0128 | 0.31 | 2.31 | 0.071 | 0.010 | 0.042 | 0.0025 | 0.143 | — | 0.0009 | Mo: 0.25 | Example |
| 7 | 0.0024* | 0.02 | 1.39 | 0.081 | 0.006 | 0.041 | 0.0021 | —* | 0.041 | 0.0011 | — | Comparative example |
| 8 | 0.0021* | 0.74* | 1.63 | 0.045 | 0.007 | 0.046 | 0.0025 | —* | 0.105* | — | — | Comparative example |
| 9 | 0.0099 | 0.51 | 2.31 | 0.075 | 0.010 | 0.054 | 0.0018 | 0.018 | 0.062* | — | — | Comparative example |
| 10 | 0.0181* | 0.23 | 2.29 | 0.078 | 0.009 | 0.048 | 0.0021 | 0.150 | — | — | — | Comparative example |
| 11 | 0.0083 | 0.10 | 0.35* | 0.071 | 0.007 | 0.033 | 0.0020 | 0.019 | 0.080* | 0.0005 | — | Comparative example |
| 12 | 0.0052 | 0.08 | 1.20 | 0.080 | 0.018 | 0.034 | 0.0032 | — | 0.192* | 0.0010 | — | Comparative example |
| 13 | 0.0089 | 1.20* | 1.60 | 0.085 | 0.009 | 0.035 | 0.0028 | — | 0.185* | 0.0018 | — | Comparative example |

TABLE 7

| | | | Characteristics of steel sheet | | | | | | Formability Critical fracture | Longitudinal crack transition | Resistance | |
|---|---|---|---|---|---|---|---|---|---|---|---|---|
| No. | Steel No. | Annealing condition | YP (MPa) | TS (MPa) | EI (%) | n value* | r value | Grain size (μm) | cushion force (TON) | temperature (° C.) | to rough surface | Remark |
| 1 | 1 | CGL | 241 | 405 | 37.8 | 0.216 | 1.85 | 7.6 | 75 | −80° C. | ○ | Example |
| 2 | 2 | CAL | 262 | 442 | 36.1 | 0.202 | 1.79 | 6.9 | 70 | −70° C. | ○ | Example |
| 3 | 2 | CGL | 263 | 445 | 36.3 | 0.199 | 1.77 | 6.8 | 70 | −60° C. | ○ | Example |
| 4 | 2 | BAF | 267 | 440 | 37.3 | 0.203 | 1.82 | 7.3 | 75 | −65° C. | ○ | Example |
| 5 | 3 | CAL | 271 | 448 | 36.7 | 0.194 | 1.82 | 7.2 | 65 | −70° C. | ○ | Example |
| 6 | 4 | CGL | 267 | 444 | 37.1 | 0.196 | 1.80 | 6.7 | 65 | −70° C. | ○ | Example |
| 7 | 5 | CAL | 285 | 472 | 35.9 | 0.191 | 1.82 | 6.8 | 75 | −65° C. | ○ | Example |
| 8 | 6 | CAL | 299 | 495 | 34.1 | 0.186 | 1.81 | 6.6 | 70 | −65° C. | ○ | Example |
| 9 | 7 | CGL | 245 | 401 | 35.1 | 0.178 | 1.62 | 10.2 | 40 | −15° C. | x | Comparative example |
| 10 | 8 | CGL | 273 | 445 | 35.9 | 0.175 | 1.61 | 10.9 | 45 | 0° C. | x | Comparative example |
| 11 | 9 | BAF | 289 | 476 | 34.2 | 0.162 | 1.55 | 9.6 | 40 | −5° C. | x | Comparative example |
| 12 | 10 | CAL | 305 | 493 | 33.0 | 0.158 | 1.51 | 9.2 | 45 | −5° C. | x | Comparative example |
| 13 | 11 | CGL | 243 | 399 | 35.1 | 0.174 | 1.56 | 10.2 | 40 | −20° C. | x | Comparative example |
| 14 | 12 | CGL | 289 | 475 | 32.2 | 0.163 | 1.62 | 9.6 | 35 | −15° C. | x | Comparative example |
| 15 | 13 | CAL | 361 | 593 | 25.9 | 0.149 | 1.59 | 6.4 | 40 | −10° C. | x | Comparative example |

Embodiment 4

The Embodiment 4-1 is a steel sheet which consists essentially of: 0.0040 to 0.02% C, 1.0% or less Si, 0.1 to 1.0% Mn, 0.01 to 0.07% P, 0.02% or less S, 0.01 to 0.1% Al, 0.004% or less N, 0.15% or less Nb, by mass %, and balance of substantially Fe. The steel sheet satisfies eq. (21), $$(12/93)\times Nb^*/C \geqq 1.2 \quad (21)$$

where, $Nb^*=Nb-(93/14)\times N$, and where, C, N, and Nb designate content of respective elements, (mass %), and the metal structure and the material satisfy eq. (22), $$YP \leqq -60\times d+770 \quad (22)$$

Where, YP designates yield strength [MPa], and d designates average size of ferritic grains [μm].

The Embodiment 4-1 was derived through an extensive study of technology to improve the resistance to secondary working brittleness and the formability without adding B that gives limitation on improving the residual solid solution C hindering the non-aging property and limiting the improvement of the r value, and without controlling the grain boundary shape by NbC that degrades the elongation and the flanging property. As a result, a high strength cold-rolled steel sheet or a high strength zinc-base sheetd steel sheet, which have non-aging property and deep drawing performance, and provide excellent resistance to secondary working brittleness, was found to be attained by controlling the contents of C, N, and Nb, and the relation therebetween, within a specified range, and further by refining the grain sizes. Thus, the Embodiment 4-1 was established.

The following is the description about the chemical composition, the metallic structure, and the material of the Embodiment 4-1.

C: 0.0040 to 0.02% (Mass %, and so Forth)

Carbon is added to 0.0040% or more for securing strength. If, however, the C content exceeds 0.02%, carbide precipitates appear at grain boundaries, and the resistance to secondary working brittleness degrades. Therefore, the C content is specified to a range of from 0.0040 to 0.02%.

Si: 1.0% or Less

Silicon is an effective element to secure strength. If, however, the Si content exceeds 1.0%, the surface property and the coating adhesiveness significantly degrade. Therefore, the Si content is specified to 1.0% or less.

Mn: 0.1 to 0.7%

Manganese precipitates S in steel as MnS to prevent the generation of hot-cracking in a slab. Furthermore, Mn increases strength without degrading the zinc-coating adhesiveness. To fix S, the Mn content is necessary 0.1% or more. On the other hand, excessive addition of Mn reduces ductility along with the increase in strength. Therefore, the Mn content is specified to a range of from 0.1 to 0.7%.

P: 0.01 to 0.07

Phosphorus is an effective element to secure strength, and P is added to 0.01% or more. If, however, the P content exceeds 0.07%, the alloying treatability of the zinc plating degrades. Therefore, the P content is specified to a range of from 0.01 to 0.07%.

S: 0.02% or Less

Sulfur degrades the hot-workability and increases the sensitivity to hot-cracking. If the S content exceeds 0.02%, fine MnS precipitates to degrade the workability. Therefore, the S content is specified to 0.02% or less.

Al: 0.01 to 0.1%

Aluminum is added to precipitate N in steel as AlN to minimize the amount of residual solid solution N. The effect is insufficient if the Al content is less than 0.01%. And, if the Al content exceeds 0.1%, the remained solid solution Al degrades the ductility. Therefore, the Al content is specified to a range of from 0.01 to 0.1%.

N: 0.004% or Less

Nitrogen is precipitated as AlN and is detoxified. To detoxify N as far as possible even at the above-described lower limit of Al content, the N content is specified to 0.004% or less.

Nb: 0.15% or Less

Niobium is added to fix the solid solution C to improve the resistance to secondary working brittleness and the formability. If, however, excessive amount of Nb, over 0.15%, is added, the ductility degrades. Therefore, the Nb content is specified to 0.15% or less.

Relation between Nb and C, N: $(12/93)\times Nb^*/C \geqq 1.2$, $Nb^*=Nb-(93/14)\times N$ The inventors of the present invention conducted an investigation on steel S focusing on the relation between Nb and C, N, from the viewpoint of non-aging property and on workability, and found that these characteristics significantly depend on the value of Nb* (effective Nb amount) determined by subtracting a value of Nb chemically equivalent with N from the Nb amount. The Nb* is expressed by the following formula.

$$Nb^*=Nb-(93/14)\times N$$

Further investigation derived that the ratio of Nb* to C amount, Nb*/C, gives influence on the non-aging property and the workability. Particularly for the non-aging property, if the value of Nb*/C becomes less than 1.2 of chemical equivalent, an yield point elongation (YPEl) appears by aging at normal temperature for a long period, as described below. Also the r value which is an index for workability similarly provides stably a high value when the Nb*/C becomes 1.2 or more of chemical equivalent. Consequently, the relation between Nb and C, N is defined by eq. (21), $$(12/93)\times Nb^*/C \geqq 1.0 \quad (21)$$

where, $Nb^*=Nb-(93/14)\times N$

Relation between metallic structure and material: $YP \leqq -60\times d+770$

Furthermore, the inventors of the present invention conducted an investigation on steels focusing on the relation between the metallic structure and the material, in view of the resistance to secondary working brittleness, and found that the ferritic grain size d [μm] and the yield point strength YP [MPa] are the characteristics that significantly affect on the resistance to secondary working brittleness. The investigation confirmed that the resistance to secondary working brittleness drastically increases by adequately controlling the value of a weighed sum of these characteristics, [YP+120×d] to a specific level or smaller. Consequently, the relation between the ferritic grain size and the yield strength is specified to eq. (22), as described below, $$YP \leqq -60\times d+770 \quad (22)$$

where, YP designates the yield strength [MPa] and d designates the ferritic grain average size [μm].

As described above, if the composition satisfies the range of the present invention, and if the above-given eqs. (21) and (22) are satisfied, a high strength steel sheet having excellent non-aging property and workability applicable to body exterior sheets of automobiles and having resistance to secondary working brittleness is attained. Furthermore, the high strength zinc-base sheetd steel sheet according to the present invention assures about 30 MPa of strength through the strengthening of NbC dispersion and precipitation, so that the necessary adding amount of solid solution strengthening elements such as Si and P can be reduced, thus providing excellent surface quality.

Since the high strength steel sheet according to the present invention completely fixes the solid solution C and N by the above-specified eq. (21), the steel sheet shows no material degradation caused from high temperature aging, and induces no aging problem even when it is exposed to a relatively high ambient temperature, such as in summer season, for a long period.

The Embodiment 4-2 is a steel sheet that is a modification of the steel of the Embodiment 4-1, having a chemical composition consisting essentially of: 0.0040 to 0.02% C, 1.0% or less Si, 0.1 to 1.0% Mn, 0.01 to 0.07% P, 0.02% or less S, 0.01 to 0.1% Al, 0.004% or less N, 0.15% or less Nb, 0.05% or less Ti, by mass %, and balance of substantially Fe.

The steel of the Embodiment 4-2 is a steel of the Embodiment 4-1 further adding Ti. Titanium improves the workability by forming a carbo-nitride to refine the structure of hot-rolled sheet. If, however, the Ti content exceeds 0.05%, the precipitate becomes coarse, and sufficient effect cannot be attained. Therefore, the Ti content is specified to 0.05% or less.

The Embodiment 4-3 is a steel sheet that is a modification of the steel of the Embodiment 4-1, having a chemical composition consisting essentially of: 0.0040 to 0.02% C, 1.0% or less Si, 0.1 to 1.0% Mn, 0.01 to 0.07% P, 0.02% or less S, 0.01 to 0.1% Al, 0.004% or less N, 0.15% or less Nb, 0.002% or less B, by mass %, and balance of substantially Fe.

The steel of the Embodiment 4-3 is a steel of the Embodiment 4-1 further adding B to strengthen the grain boundaries and to improve the resistance to secondary working brittleness. If, however, the B content exceeds 0.002%, the formability significantly degrades. Therefore, the B content is specified to 0.002% or less.

The Embodiment 4-4 is a steel sheet that is a modification of the steel of the Embodiment 4-1, having a chemical composition consisting essentially of: 0.0040 to 0.02% C, 1.0% or less Si, 0.1 to 1.0% Mn, 0.01 to 0.07% P, 0.02% or less S, 0.01 to 0.1% Al, 0.004% or less N, 0.15% or less Nb, 0.05% or less Ti, 0.002% or less B, by mass %, and balance of substantially Fe.

The steel of the Embodiment 4-4 is a steel of the Embodiment 4-1 further adding Ti and B to improve the quality and the resistance to secondary working brittleness. Titanium improves the workability by forming a carbo-nitride to refine the structure of hot-rolled sheet. Boron strengthens the grain boundaries and improves the resistance to secondary working brittleness. If, however, the Ti content exceeds 0.05%, the precipitate becomes coarse. And, if the B content exceeds 0.002%, the formability significantly degrades. Therefore, the upper limit of the Ti content is specified to 0.05%, and the upper limit of the B content is specified to 0.002%.

The above-described Embodiments 4-1 through 4-4 may use a galvanized steel sheet prepared by applying zinc plating onto the high strength steel sheet according to the respective Embodiments. The characteristics of the high strength steel sheet are not degraded by the treatment of zinc plating, and the excellent resistance to secondary working brittleness is secured.

The Embodiment 4-5 is a method for manufacturing a high strength steel sheet, which comprises the steps of: hot-rolling a steel slab having an above-described composition at finish temperatures of Ar3 transformation point or above; coiling the hot-rolled steel sheet at temperatures of from 500 to 700° C.; cold-rolling and annealing the coiled hot-rolled steel sheet.

The Embodiment 4-5 provides a method for manufacturing a high strength steel sheet using the above-described chemical composition. The conditions and other items of the manufacturing method are described below.

Finish temperature of hot-rolling: $Ar_3$ transformation point or above

If the finish-temperature is below the $Ar_3$ transformation point, the formability degrades, and the n value in low strain regions of the 1 to 10% levels degrades, which is disadvantageous for the resistance to secondary working brittleness. Therefore, the finish temperature is specified to the Ar3 transformation point or above.

Coiling temperature of hot-rolling: 500 to 700° C.

The coiling is necessary to be carried out at temperatures of 500° C. or above to fully precipitate NbC, and of 700° C. or below to prevent the occurrence of dents on the steel surface caused from peeled scale. Therefore, the steel sheet after hot-rolling is coiled at temperatures of from 500 to 700° C.

Hot-rolling of a slab can be done either after heating in a reheating furnace or directly without heating. The conditions of cold-rolling, annealing, and galvanizing are not specifically limited, and normally applied conditions can attain the wanted effect.

The Embodiment 4-6 is a method for manufacturing a high strength zinc-base sheetd steel sheet, which method containing each step of the Embodiment 4-5 and the step of zinc-base plating on the annealed steel sheet.

The Embodiment 4-6 provides the target effect on not only a hot dip zinc-base sheetd steel sheet but also an electrolytic zinc-base sheetd steel sheet. The zinc-base sheetd steel sheet according to the present invention may further be applied with an organic coating after the plating.

In these means, the phrase "balance of substantially Fe" means that inevitable impurities and other trace amount elements may be included in the scope of the present invention unless they diminish the action and effect of the present invention.

On implementing the present invention, the galvanized steel sheet may be prepared by manufacturing a cold-rolled steel sheet under an adjustment of chemical composition as described above, then, at need, by applying zinc plating thereon. For a part of the chemical composition, individual characteristics can be improved by the following-given modifications.

Regarding C, the C content is specified to a range of from 0.0050 to 0.0080%, preferably from 0.0050 to 0.0074%, to adequately control the mode of precipitate and of dispersion and further to improve the resistance to secondary working. brittleness, thus to attain more preferable performance.

As for Si, the Si content is preferably specified to 0.7% or less to further improve the surface property and the coating adhesiveness.

For Nb, the Nb content is preferably specified to more than 0.035% to adequately control the mode of precipitate and of dispersion and further to improve the resistance to secondary working brittleness. For further improving the resistance to secondary working brittleness and for further improving the total performance, the Nb content is preferably 0.080% or more. However, in view of cost, the upper limit of Nb content is preferably 0.140%. Consequently, the Nb content is specified to above 0.035%, preferably in a range of from 0.080 to 0.140%.

As for the relation between Nb and C, N, the description is given in the following referring to the experimental investigations. According to the experiment, slabs having various C contents, 0.0040 to 0.01%, were prepared. These slabs were treated by hot-rolling, pickling, cold-rolling, annealing at 830° C., and temper-rolling to 0.5% of draft percentage. The r value which is an index of deep drawing performance was determined. And, a three months of aging was given at 30° C. for evaluating the aging property by determining YPEl under a tensile test.

Figure 10:
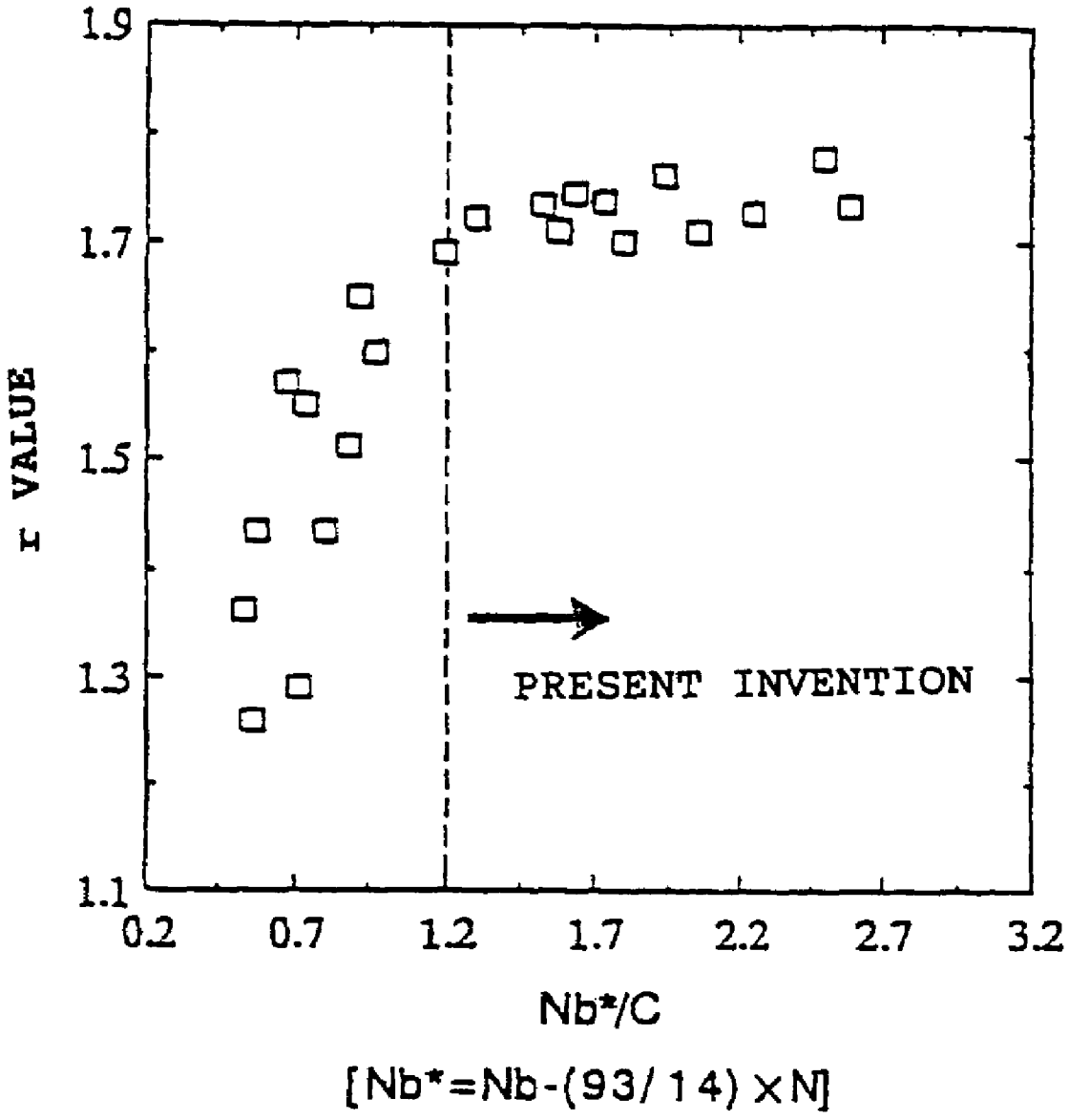
FIG. 10 is a graph showing the influence of Nb and C on the deep drawing performance, relating to the Embodiment 4.

FIG. 10 shows the relation between $[(12/93)\times Nb^*/C]$ and the r value. The figure shows that the range of $[(12/93)\times Nb^*/C]\geqq 1.2$ generally gives 1.7 or higher excellent r values.

Figure 11:
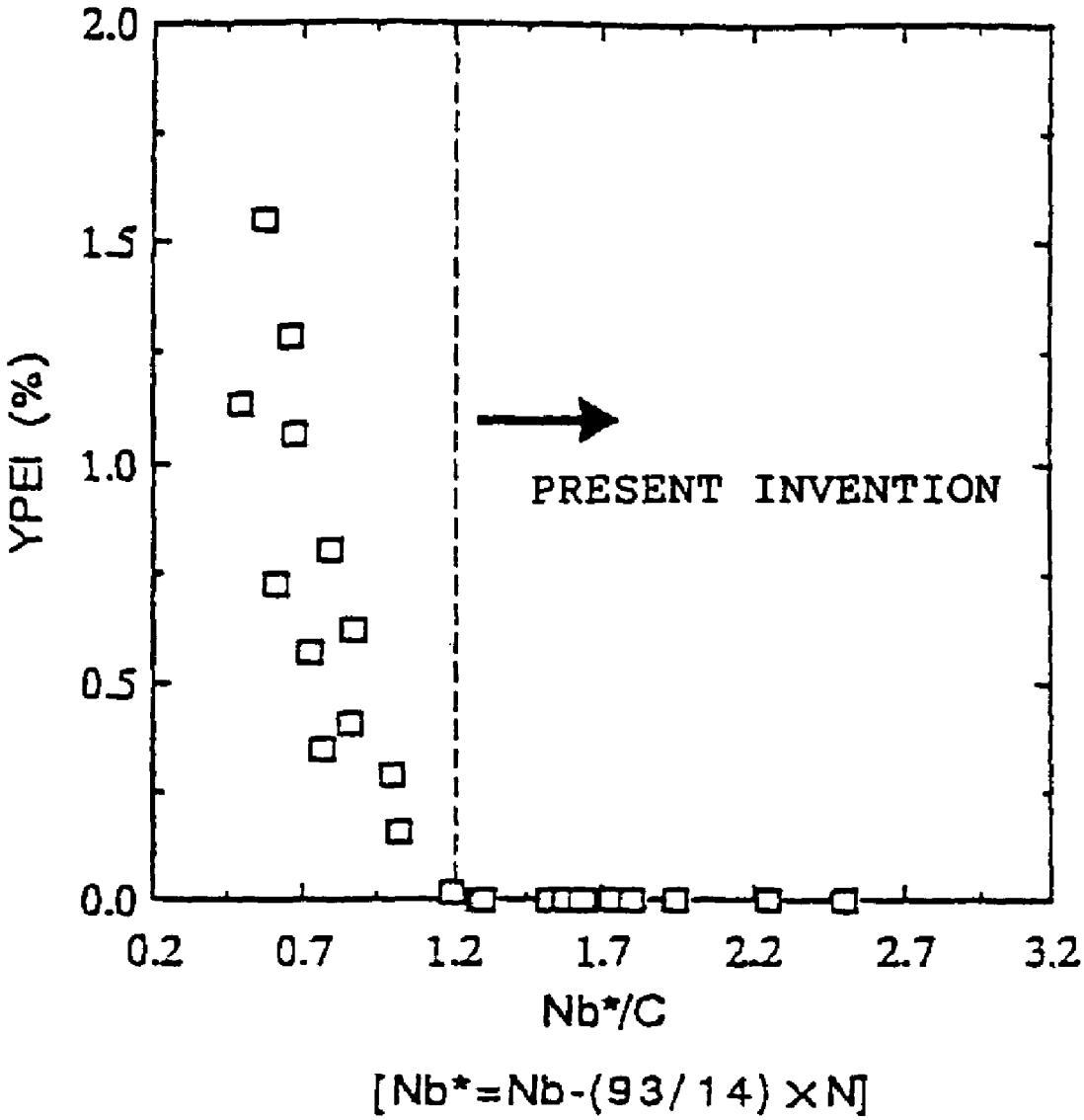
FIG. 11 is a graph showing the influence of Nb and C on the non-aging property, relating to the Embodiment 4.

FIG. 11 shows the relation between $[(12/93)\times Nb^*/C]$ and YPEl. The figure shows that the range of $[(12/93)\times Nb^*/C]\geqq 1.2$ completely fixes the solid solution C, without giving YPEl, thus providing excellent non-aging property.

Consequently, $[(12/93)\times Nb^*/C]$ is defined by eq. (1) given above. According to the present invention, it is preferable to limit the value of $[(12/93)\times Nb^*/C]$ within a range of from 1.3 to 2.2 from the standpoint of material and cost balance.

The inventors of the present invention conducted experimental investigations also on the relation between the metal structure and the material. According to the experiment, the transition temperature of secondary working brittleness was determined using the specimens prepared in a similar procedure with the above-described experiments. The term "transition temperature of secondary working brittleness" designates the temperature that a material after deep drawing treatment becomes brittle during the secondary working.

According to the experiment, a blank having 105 mm in diameter was punched from a steel sheet, which blank was treated by deep drawing, and cut at edge to make the cup height 35 mm. Then, the cup was immersed in a cooling medium such as ethyl alcohol each at a constant temperature. A conical punch was applied to extend the edge of cup to induce fracture. Thus, the temperature that the fracture mode of the cup transfers from the ductile fracture to the brittle fracture was determined. The temperature is defined as the transition temperature of secondary working brittleness.

Figure 12:
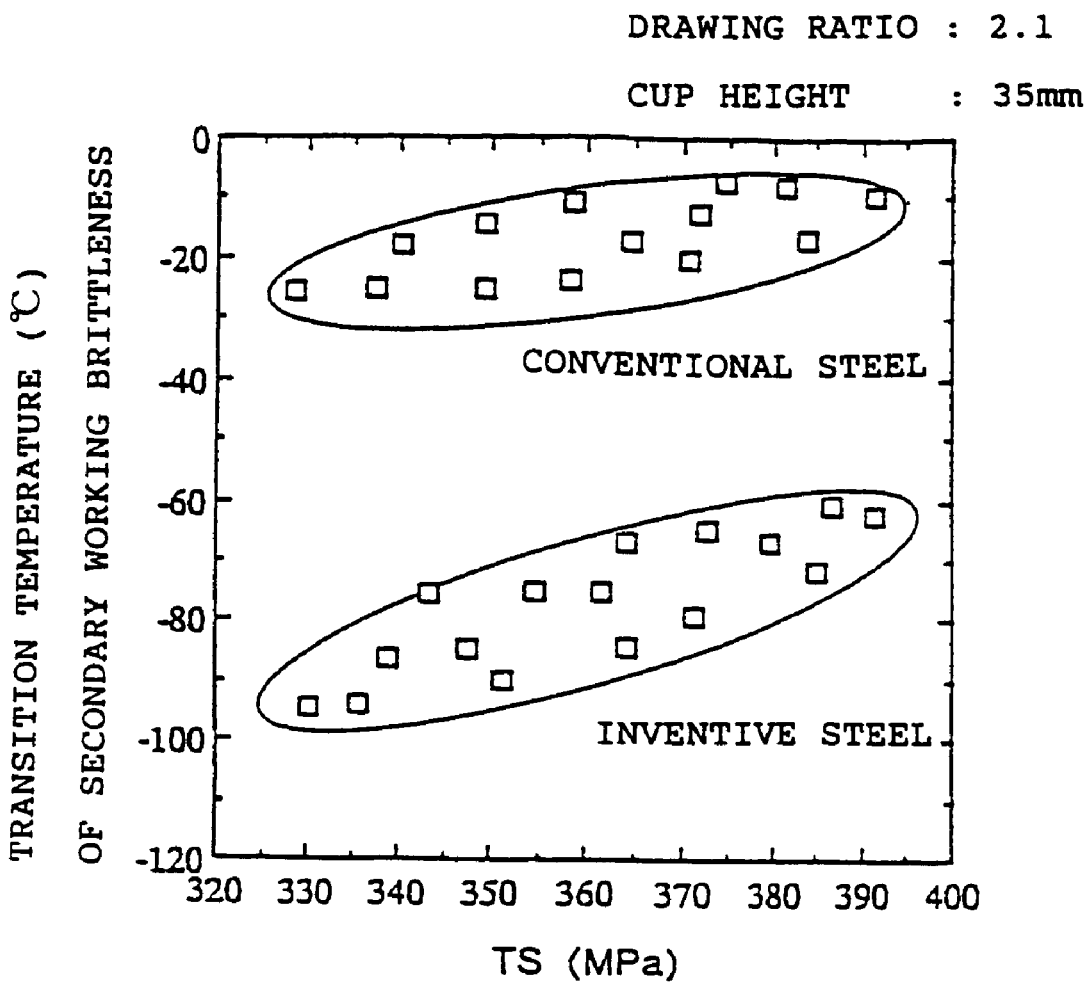
FIG. 12 is a graph showing the relation between the tensile strength TS and the secondary working brittleness transition temperature, relating to the Embodiment 4.

FIG. 12 shows the relation between the tensile strength TS and the transition temperature of secondary working brittleness. Under the comparison with a conventional steel having a same level of strength, the steel according to the present invention, satisfying eq. (22), shows extremely superior resistance to secondary working brittleness. Main reason that the steel according to the present invention shows superior resistance to secondary working brittleness is presumably that, under comparison with same level of strength, the steel according to the present invention, satisfying eq. (22), has fine grains.

According to an observation under an electron microscope, the steel according to the present invention contains fine and uniformly distributed NbC in grain, and has very few precipitates in the vicinity of grain boundary, or a microscopic structure presumably what is called a precipitate free zone (PFZ) is formed. The existence of PFZ which is readily plastic-deforming at near the grain boundary may also contribute to the improved resistance to secondary working brittleness.

Furthermore, the steel according to the present invention has high n value in a low strain region of from 1 to 10%, thus the deformation at a portion contacting with the punch bottom during drawing increases, and the volume of inflow during the deep drawing decreases, which may reduce the degree of compression working during the shrinking flange deformation. The feature also supposedly contributes to the improvement of resistance to secondary working brittleness.

In the present invention, to further improve the resistance to secondary working brittleness, it is more preferable to change the constant in the right term of eq. (22) as in eq. (22'), $$YP[\text{MPa}] \leqq -60 \times d[\mu\text{m}] + 750 \quad (22')$$

If Ti is added, particularly from the viewpoint of surface property on hot dip galvanizing, the upper limit of Ti content is specified to 0.02%, if possible, and to attain necessary grain refinement effect, the lower limit thereof is specified to preferably 0.005%.

If B is added, when considering that the steel according to the present invention has refined grains and shows extremely strong resistance to secondary working brittleness, the B content is preferably specified to a range of from 0.0001 to 0.001% to minimize the degradation of formability.

Also in the Embodiment 4-4, the Ti content is preferably specified to a range of from 0.005 to 0.02%, and the B content is preferably specified to a range of from 0.0001 to 0.001%, to assure the refinement effect and the formability.

Also in the method for manufacturing high strength steel sheet in the Embodiment 4-5 and the Embodiment 4-6, the above-described effects can be obtained by controlling the chemical composition thereof to above-described preferred range of the Embodiments 4-1 through 4-4.

The high strength steel sheet according to the present invention completely fixes the solid solution C and N by satisfying the above-given eq. (21). Accordingly, the BH value (baking and hardening property) is less than 2 kgf/mm$^2$, thus the material degradation owing to high temperature aging is less. Therefore, aging does not become a problem even when the steel is exposed during summer, or at a relatively high ambient temperature, for a long period. Furthermore, the steel sheet has excellent workability at welded portions, and the sheet is applicable to new technologies such as tailored blank.

EXAMPLES

Steels of Nos. 1 through 20 each having respective chemical compositions given in Table 8 were prepared by melting process, which were then treated by continuous casting to obtain slabs having a thickness of 250 mm. Each of the slabs was heated to 1,200° C., and hot-rolled at finish temperatures of from 870 to 940° C., and at coiling temperatures of from 600 to 650° C. to prepare a hot-rolled steel sheet having a thickness of 2.8 mm. The hot-rolled steel sheet was treated by pickling, then by cold-rolling to a thickness of 0.7 mm, and by continuous annealing at temperatures of from 800 to 860° C., at a plating bath temperature of 460° C., and an alloying treatment temperature of 500° C. in a continuous hot dip galvanizing line.

After that, for these galvanized steel sheets, temper rolling at 0.7% of draft percentage was applied. The mechanical properties, the grain sizes, and the surface property of these steel sheets were determined. The specimens for the tensile test were those conforming to JIS No.5 tensile test, sampled in L-direction of the steel sheet. The aging property was evaluated by the yield elongation, YPEl, determined by the tensile test after aged at 30° C. for 3 months. With the cup drawing test method similar with that described above, the resistance to secondary working brittleness was determined. Table 2 shows the results of investigations and tests.

As seen in Table 9, the Example steels Nos. 1 through 10 according to the present invention showed excellent formability, and excellent resistance to secondary working brittleness giving −70° C. or lower transition temperature of secondary working brittleness, further gave no problem of surface property, and gave non-aging property. The Example steels according to the present invention were further confirmed to have excellent workability of welded portions and excellent fatigue characteristics.

To the contrary, the Comparative Example steels Nos. 11 through 20 showed coarse grains, and gave significantly inferior transition temperature of secondary working brittleness to the Example steels according to the present invention. For example, the Comparative Example steel No. 11 was treated at a finish temperature not higher than Ar3 point, the Comparative Example steel No. 15 gave inadequate Nb*/C value, and the Comparative Example steels Nos. 18, 19, and 20 had inadequate amount of Mn, Si, and C, respectively, so that they were not satisfactory in formability. As for the Comparative Example steels Nos. 13, 14, 17, and 19, the content of Ti, Si, or the sum of Ti and Si was outside of the-range of the present invention, thus giving very poor surface property.

TABLE 8

| No. | C | Si | Mn | P | S | N | Nb | Ti | B | (12/93)/(Nb*/C) | Finish temperature (° C.) | Remark |
|---|---|---|---|---|---|---|---|---|---|---|---|---|
| 1 | 0.0051 | 0.01 | 0.13 | 0.011 | 0.012 | 0.0023 | 0.065 | — | — | 1.26 | 905 | Example steel |
| 2 | 0.0049 | 0.05 | 0.15 | 0.009 | 0.007 | 0.0019 | 0.078 | 0.016 | — | 1.72 | 913 | Example steel |
| 3 | 0.0061 | 0.02 | 0.36 | 0.021 | 0.009 | 0.0026 | 0.082 | — | — | 1.37 | 895 | Example steel |
| 4 | 0.0065 | 0.02 | 0.34 | 0.019 | 0.010 | 0.0030 | 0.095 | — | — | 1.49 | 900 | Example steel |
| 5 | 0.0068 | 0.01 | 0.35 | 0.022 | 0.012 | 0.0018 | 0.120 | — | — | 2.05 | 940 | Example steel |
| 6 | 0.0068 | 0.03 | 0.65 | 0.041 | 0.010 | 0.0025 | 0.090 | — | — | 1.39 | 915 | Example steel |
| 7 | 0.0066 | 0.05 | 0.67 | 0.039 | 0.009 | 0.0016 | 0.110 | — | 0.0005 | 1.94 | 890 | Example steel |
| 8 | 0.0063 | 0.26 | 0.49 | 0.014 | 0.010 | 0.0029 | 0.125 | — | — | 2.17 | 905 | Example steel |
| 9 | 0.0062 | 0.11 | 0.91 | 0.049 | 0.008 | 0.0022 | 0.079 | 0.011 | 0.0004 | 1.34 | 911 | Example steel |
| 10 | 0.0095 | 0.01 | 0.99 | 0.030 | 0.016 | 0.0021 | 0.138 | — | — | 1.68 | 915 | Example steel |
| 11 | 0.0054 | 0.02 | 0.13 | 0.012 | 0.015 | 0.0026 | 0.064 | — | — | 1.12* | 870* | Comparative example steel |
| 12 | 0.0023* | 0.05 | 0.15 | 0.010 | 0.013 | 0.0028 | 0.023 | — | — | 0.25* | 905 | Comparative example steel |
| 13 | 0.0021* | 0.07 | 0.65 | 0.047 | 0.011 | 0.0025 | 0.019 | 0.031 | — | 0.15* | 895 | Comparative example steel |
| 14 | 0.0023* | 0.02 | 0.45 | 0.055 | 0.008 | 0.0025 | — | 0.048 | 0.0011 | — | 915 | Comparative example steel |
| 15 | 0.0065 | 0.01 | 0.34 | 0.019 | 0.012 | 0.0029 | 0.047 | — | — | 0.55* | 900 | Comparative example steel |
| 16 | 0.0023* | 0.02 | 0.95 | 0.075* | 0.013 | 0.0024 | 0.027 | 0.014 | 0.0004 | 0.62* | 935 | Comparative example steel |
| 17 | 0.0021* | 0.25 | 0.94 | 0.045 | 0.012 | 0.0030 | — | 0.075 | — | — | 920 | Comparative example steel |
| 18 | 0.0061 | 0.02 | 1.32* | 0.011 | 0.009 | 0.0021 | 0.066 | — | — | 1.10* | 915 | Comparative example steel |
| 19 | 0.0031* | 1.02* | 0.21 | 0.015 | 0.008 | 0.0022 | 0.0129 | — | — | 4.76 | 895 | Comparative example steel |
| 20 | 0.0151* | 0.03 | 0.59 | 0.035 | 0.009 | 0.0028 | 0.166* | — | — | 1.26 | 905 | Comparative example steel |

TABLE 9

| No. | YP (MPa) | TS (MPa) | r value | Grain size (μm) | Tc** (° C.) | Yield elongation (%) | Surface property | Remark |
|---|---|---|---|---|---|---|---|---|
| 1 | 191 | 322 | 1.76 | 8.5 | −100 | 0 | ○ | Example steel |
| 2 | 190 | 324 | 1.82 | 8.3 | −95 | 0 | ○ | Example steel |
| 3 | 202 | 341 | 1.85 | 7.9 | −90 | 0 | ○ | Example steel |
| 4 | 205 | 345 | 1.88 | 7.7 | −85 | 0 | ○ | Example steel |
| 5 | 206 | 346 | 1.92 | 7.8 | −90 | 0 | ○ | Example steel |
| 6 | 221 | 370 | 1.87 | 7.5 | −75 | 0 | ○ | Example steel |
| 7 | 224 | 372 | 1.89 | 7.4 | −90 | 0 | ○ | Example steel |
| 8 | 225 | 376 | 1.94 | 7.3 | −70 | 0 | ○ | Example steel |
| 9 | 232 | 391 | 1.92 | 7.1 | −75 | 0 | ○ | Example steel |
| 10 | 231 | 393 | 1.98 | 7.2 | −70 | 0 | ○ | Example steel |
| 11 | 195 | 321 | 1.51 | 11.3 | −15 | 0 | ○ | Comparative example steel |
| 12 | 198 | 325 | 1.61 | 11.9 | −10 | 0.8 | ○ | Comparative example steel |
| 13 | 211 | 344 | 1.63 | 10.6 | −5 | 0 | x | Comparative example steel |
| 14 | 215 | 345 | 1.61 | 10.8 | −30 | 0 | x | Comparative example steel |
| 15 | 210 | 348 | 1.67 | 10.1 | −10 | 0.7 | ○ | Comparative example steel |
| 16 | 225 | 372 | 1.62 | 10.1 | −30 | 0 | ○ | Comparative example steel |
| 17 | 228 | 375 | 1.69 | 10.4 | 0 | 0 | x | Comparative example steel |
| 18 | 223 | 377 | 1.64 | 9.9 | −5 | 0.1 | ○ | Comparative example steel |
| 19 | 239 | 393 | 1.63 | 9.6 | 0 | 0 | x | Comparative example steel |
| 20 | 241 | 395 | 1.65 | 9.5 | −5 | 0 | ○ | Comparative example steel |

Embodiment 5

The Embodiment 5-1 is a steel sheet which consists essentially of: 0.0040 to 0.02% C, 1.0% or less Si, 0.1 to.1.0% Mn, 0.01 to 0.07% P, 0.02% or less S, 0.01 to 0.1% sol.Al, 0.004% or less N, 0.01to 0.14% Nb, by mass %, and balance of substantially Fe. And an n value determined by 10% or lower deformation in a uniaxial tensile test is 0.21 and satisfies eq. (31), $$YP \leqq -60 \times d + 770 \quad (31)$$

where, YP designates the yield strength [MPa] and d designates the ferritic grain average size [μm].

The Embodiment 5-1 was conducted during a detail investigation on the control variables of formability of formed products of components being mainly subjected to stretch-forming, such as front fender and side panel. In the stretch-oriented forming, it was found that the deformation was small at the portion contacted with punch bottom, which occupied most part of the formed product, and was concentrated on the punch shoulder at side wall section and on the periphery of die shoulder.

Accordingly, by letting the strain generated in the steel sheet at the wide portion contacting with the punch bottom increase, the strain concentration at the punch shoulder at side wall section and at the die shoulder, where are the areas of possible fracture, can be relaxed. On that point, there was derived a finding that it is effective to improve the n value in a low strain region, corresponding to the strain generated in the portion contacting with the punch bottom, not to improve the n value in a high strain region conventionally used for evaluating the stretch performance. The investigation further derived a finding that it is necessary to have a low YP and to refine the grains for ensuring resistance to rough surface after the press-forming.

To do this, the inventors of the present invention found that, through the studies including detail observation using electron microscope and the like, different from conventional IF steels, it is effective to use an Nb—IF steel which contains C by 40 ppm or more and which utilizes Nb as an element to form carbo-nitrides, and that the control of microscopic structure and precipitate mode in the steel sheet significantly improves the n value in a low strain region, and further refines the grain sizes. The present invention was completed on the basis of those findings and on further detailed investigations. The features of the present invention are the following.

First, the reasons to limit the composition range (chemical composition) are described below.

C: 0.0040 to 0.02%

Carbide being formed with Nb gives influence on the base material strength and on the strain propagation in a low strain region during panel formation, and increases the strength and the formability. If the C content is less than 0.0040%, the effect cannot be attained. If the C content exceeds 0.01%, the ductility degrades and the formability degrades, though the strength and the sufficient strain propagation in a low strain region are attained. Therefore, the C content is specified to a range of from 0.0040 to 0.02%.

Si: 1.0% or Less

Silicon is an effective element to secure strength. If, however, the Si content exceeds 1.0%, the chemical conversion treatability and the surface property significantly degrade. Therefore, the Si content is specified to 1.0% or less.

Mn: 0.1 to 1.0%

Manganese is an essential element for steel because Mn has a function to prevent hot-cracking of slab by precipitating S in steel as MnS, and 0.1% or more of Mn content is necessary to precipitate and fix S. Also Mn is an element to strengthen the steel by solid solution without degrading the coating adhesiveness. However, the Mn content exceeding 1.0% is not preferable because excessive increase in the yield strength is induced to decrease the n value in a low strain region. Therefore, the Mn content is specified to a range of from 0.1 to 1.0%.

P: 0.01 to 0.07%

Phosphorus is an effective element to strengthen steel, and the effect appears at 0.01% or more of P addition. If, however, the P content exceeds 0.07%, the alloying treatability during galvanization degrades, and insufficient appearance of panel occurs caused from the insufficient coating adhesiveness and the resulted waving. Therefore, the P content is specified to a range of from 0.01 to 0.07%.

S: 0.02% or Less

Sulfur exists in steel as MnS. Excessive S content induces degradation of ductility to result in degraded press-formability. In practical application, the S content that does not induce defective formability is 0.02% or less. Therefore, the S content is specified to 0.02% or less.

Sol.Al: 0.01 to 0.1%

Aluminum is added to steel by 0.01% or more to precipitate N in the steel as AlN, and to eliminate residual solid solution C. If the sol.Al content is less than 0.01%, the effect is insufficient. And, if the sol.Al content exceeds 0.1%, the solid solution Al induces degradation in ductility. Therefore, the sol.Al content is specified to a range of from 0.01 to 0.1%.

N: 0.004% or Less

Nitrogen is precipitated as AlN and is detoxified. To detoxify N as far as possible even at the above-described lower limit of Al content, the N content is specified to 0.004% or less.

Nb: 0.01 to 0.14%

Niobium forms a fine carbide bonding with C, and gives influence on the base material strength and on the strain propagation in a low strain region during panel formation, thus increases the formability and the resistance to plane strain performance. If, however, the Nb content is less than 0.01%, the effect cannot be attained. And, if the Nb content exceeds 0.14%, the yield strength increases, and the sufficient strain propagation cannot be attained in a low strain region, thus degrading the ductility and formability. Therefore, the Nb content is specified to a range of from 0.01 to 0.14%.

As a feature of the present invention, the increase in the strain propagation in a low strain region of the material increases the amount of generated strain over a wide area of the material contacting with the punch bottom, thus improving the stretch forming performance. Through an investigation on the above-described variables governing the formability, the inventors of the present invention found that the strain amount is satisfactory at 10% or less. According to the present invention, the necessary n value in a region of uniaxial tensile nominal strain of 10% or less from the viewpoint of formability was determined. As a result, with the n value of 0.21 or more, the stretch forming performance was significantly improved. As an n value at deformations of 10% or less, the n value determined by the two-point method, at nominal deformation 1% and 10%, may be applied.

For the external body sheets of automobiles and the like that are also a target of the present invention, which request particularly high surface property, the surface property shall be in excellent state after a severe condition forming. Conditions to secure high stretch forming performance and to prevent rough surface appearance after press-forming were investigated, and it was found that the grains shall be refined responding to the requested yield stress. The results of the investigation were expressed in the above-given eq. (31), and the grain sizes were refined to satisfy eq. (31) to successfully prevent the surface roughening after press-forming. Consequently, according to the present invention, the yield strength YP [MPa] and the ferritic grain average size d [μm] are controlled to satisfy eq. (31).

The Embodiment 5-2 is a steel sheet that is a modification of the steel of the Embodiment 5-1, having a chemical composition consisting essentially of: 0.0040 to 0.02% C, 1.0% or less Si, 0.1 to 1.0% Mn, 0.01 to 0.07% P, 0.02% or less S, 0.01 to 0.1% sol.Al, 0.004% or less N, 0.01 to 0.14% Nb, 0.05% or less Ti, by mass %, and balance of substantially Fe.

The steel of the Embodiment 5-2 is a steel of the Embodiment 5-1 further adding Ti to refine the structure of hot-rolled sheet. Titanium forms a carbo-nitride to refine the structure of the hot-rolled sheet, thus improving the formability. If , however, the Ti content exceeds 0.05 wt. %, the precipitate becomes coarse, and sufficient effect cannot be attained. Therefore, the Ti content is specified to 0.05% or less.

The Embodiment 5-3 is a steel sheet that is a modification of the steel of the first aspect of the present invention, having a chemical composition consisting essentially of: 0.0040 to 0.02% C, 1.0% or less Si, 0.1 to 1.0% Mn, 0.01 to 0.07% P, 0.02% or less S, 0.01 to 0.1% sol.Al, 0.004% or less N, 0.01 to 0.14% Nb, 0.002% or less B, by mass %, and balance of substantially Fe.

The steel of the Embodiment 5-3 is a steel of the above-described chemical composition further adding B to improve the resistance to secondary working brittleness. Boron is added to strength the grain boundaries. If, however, the B content exceeds 0.002 wt. %, the formability significantly degrades. Therefore, theupper limit of the B content is specified to 0.002%.

The Embodiment 5-4 is a steel sheet that is a modification of the steel of the Embodiment 5-1, having a chemical composition consisting essentially of: 0.0040 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, 0.05% or less Ti, 0.002% or less B, by mass %, and balance of substantially Fe.

The steel of the Embodiment 5-4 is a steel of the Embodiment 5-1 further adding Ti and B to improve the formability and the resistance to secondary working brittleness. Titanium improves the formability by forming a carbo-nitride to refine the structure of hot-rolled sheet. Boron strengthens the grain boundaries and improves the resistance to secondary working brittleness. If, however, the Ti content exceeds 0.05%, the precipitate becomes coarse. And, if the B content exceeds 0.002%, the formability significantly degrades. Therefore, the upper limit of the Ti content is specified to 0.05%, and the upper limit of the B content is specified to 0.002%.

The Embodiment 5-5 is a high strength steel sheet of the Embodiments 5-1 through 5-4 further adding one or more of the element selected from the group consisting of: 1.0% or less Cr, 1.0% or less Mo, 1.0% or less Ni, and 1.0% or less Cu, by mass %.

The Embodiment 5-5 further adding one or more of the elements selected from the group consisting of Cr, Mn, Ni, and Cu, to the chemical composition of the above-described one according to the present invention, to provide the steel sheet with higher strength. The following is the description of the reasons to specify the content of individual elements.

Cr: 1.0% or Less

Chromium is added to increase the strength. If, however, the Cr content exceeds 1.0%, the formability degrades. Therefore, the upper limit of the Cr content is specified to 1.0%.

Mo: 1.0% or Less

Molybdenum is an effective element to secure strength. If, however, the Mo content exceeds 1.0%, the recrystallization in the γ region (autstenitic region) is delayed during hot-rolling, thus increases the rolling load. Therefore, the upper limit of the Mo content is specified to 1.0%.

Ni: 1.0% or Less

Nickel is added. If , however, the Ni content exceeds 1.0%, the transformation point significantly lowers to likely induce the appearance of low temperature transformation phase during hot-rolling. Therefore, the upper limit of the Ni content is specified to 1.0%.

Cu: 1.0% or Less

Copper is an effective element to strengthen solid solution. If, however, the Cu content exceeds 1.0%, surface defects likely occur by forming a low melting point phase during hot-rolling. Therefore, the Cu content is specified to 1.0% or less. Copper is preferably added together with Ni.

The Embodiment 5-6 is a high strength zinc-base sheetd steel sheet prepared by applying a zinc-base plating on the surface of the steel sheet of either one of the steel sheets of Embodiment 5-1 through the Embodiment 5-5.

The Embodiment 5-6 provides the corrosion resistance to the steel by further applying a zinc-base plating on the surface of the above-described steel sheet according to the present invention. The method of plating is not specifically limited, and the method may be hot dip galvanizing, electrolytic plating, and the like.

In these means, the phrase "balance of substantially Fe" means that inevitable impurities and other trace amount elements may be included in the scope of the present invention unless they diminish the action and effect of the present invention.

On implementing the present invention, adjustment of chemical composition may be given as described above. For a part of the chemical composition, individual characteristics can be improved by the following-given modifications.

Regarding C, the C content is specified to a range of from 0.0050 to 0.0080%, preferably from 0.0050 to 0.0074%, to adequately control the mode of precipitate and of dispersion and further to improve the formability and the total performance.

As for Si, the Si content is preferably specified to 0.7% or less to further improve the surface property and the coating adhesiveness.

For Nb, the Nb content is preferably specified to more than 0.035% to further increase the n value in a low strain region. For further improving the formability and total performance, the Nb content is preferably 0.08% or more. However, in view of cost, the upper limit of Nb content is preferably 0.14%.

The reason that Nb increases the n value in a low strain region is not fully analyzed. A detail observation under an electron microscope revealed the following-described assumption. When the Nb and C contents are adequately controlled, large amount of NbC precipitate in grains, and precipitate free zone (hereinafter referred to simply as PFZ), where no precipitate exists, appear in the vicinity of grain boundaries. Since PFZ is free from precipitate, the strength of the portion is lower than that inside of grain, thus the portion is able to be plastic-deformed at a low stress level. As a result, high n value is attained in a low strain region. To do this, the control of atomic equivalent ratio of Nb to C to an adequate value is effective. Through an extensive study of the inventors of the present invention, it was found that, to obtain that type of preferable precipitate mode according to the present invention, the control of Nb/C (atomic equivalent ration) in a range of from 1.3 to 2.5 is more preferable to increase the n value.

When Ti is added, the Ti content is specified to less than 0.02% from the point of surface property of hot dip galvanizing. To obtain necessary grain refinement effect, 0.005% or more is preferable.

As for B, the steel according to the present invention shows excellent resistance to secondary working brittleness without adding B, as described above. Accordingly, when B is added, it is preferred to limit the B content to a range of from 0.0001 to 0.001% to minimize the degradation of formability.

Regarding the manufacturing method, a hot-rolled steel sheet is prepared from a steel having an adjusted composition, followed by cold-rolling and annealing, as described before. Furthermore, at need, zinc plating may be applied to the surface of the cold-rolled steel sheet to obtain a galvanized steel sheet. The manufacturing method may be the one described below.

For example, a bar heater heating may be applied during hot-rolling to assure the finish rolling temperature during the manufacturing of thin sheets. From the standpoint of descaling performance in pickling and material stability, the hot-rolled steel sheet is preferably coiled at temperatures of 680° C. or below. A preferable lower limit of coiling temperature is 600° C. for the continuous annealing, and 540° C. for the box annealing.

On descaling the surface of a hot-rolled steel sheet, to provide excellent adaptability to exterior body sheet for automobiles, it is preferred to fully remove not only the primary scale but also the secondary scale formed during hot-rolling step. On conducting cold-rolling after descaling, to provide the hot-rolled steel sheet with a deep drawing performance necessary to exterior body sheet for automobile, the cold-draft percentage is preferably 50% or more.

As for the annealing temperature, when the continuous annealing is applied to a cold-rolled steel sheet, a preferred temperature range is from 780 to 880° C. When the box annealing is applied, homogeneous recrystallized structure is attained at annealing temperatures of 680° C. or above because the soaking time is long. Nevertheless, the upper limit of annealing temperature for the boxy annealing is preferably 750° C. The cold-rolled steel sheet after annealing may be applied with zinc-base plating using hot dip galvanization or electrolytic plating. Further an organic coating may be applied after the plating.

The following is detail description on the tensile characteristics and the composition, which are specified in the steel sheet according to the present invention.

Figure 13:
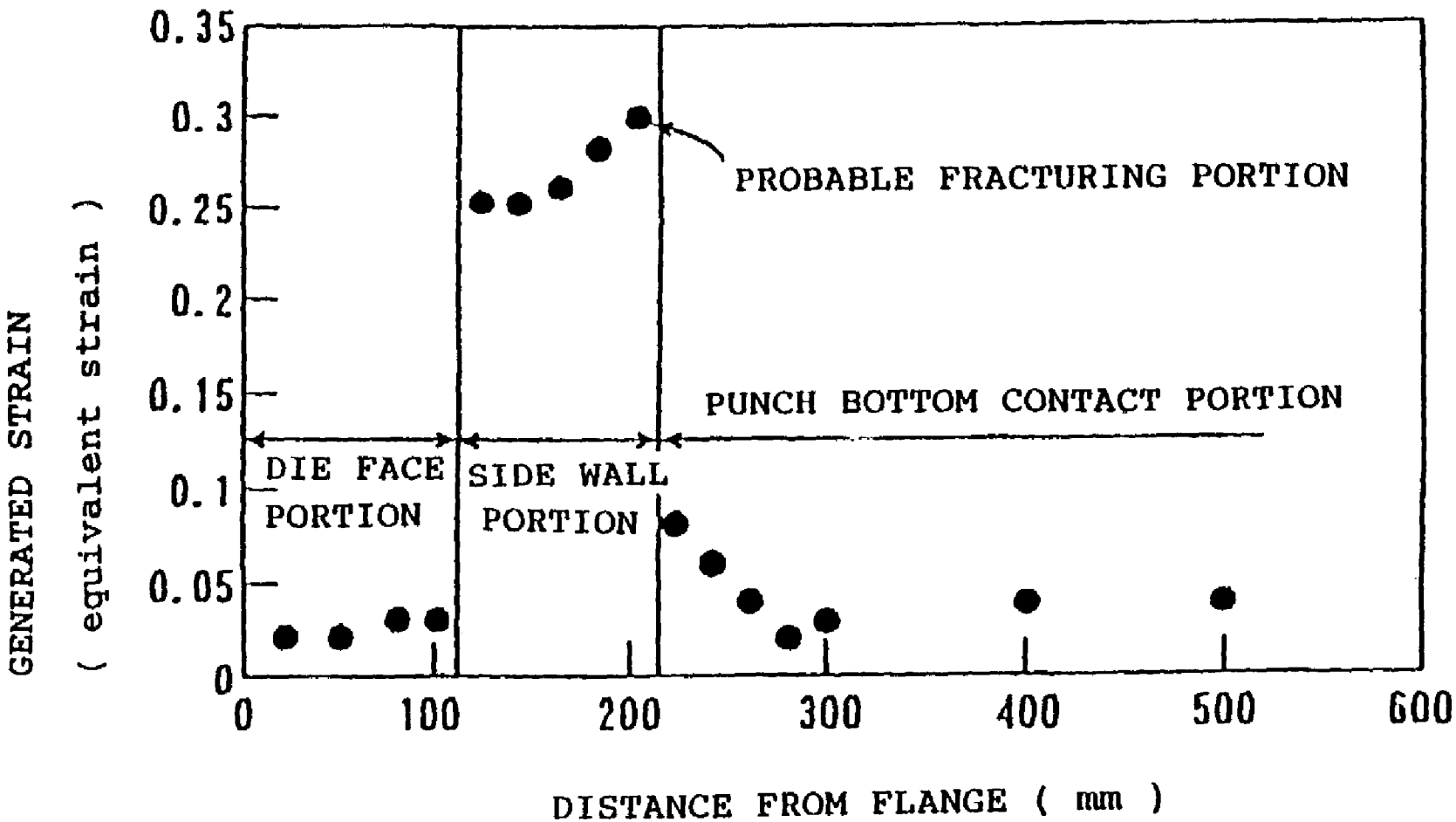
FIG. 13 is a graph showing an example of equivalent strain distribution in the vicinity of probable-fracturing section in an actual scale front fender model formed component, relating to the Embodiment 5.
Figure 14:
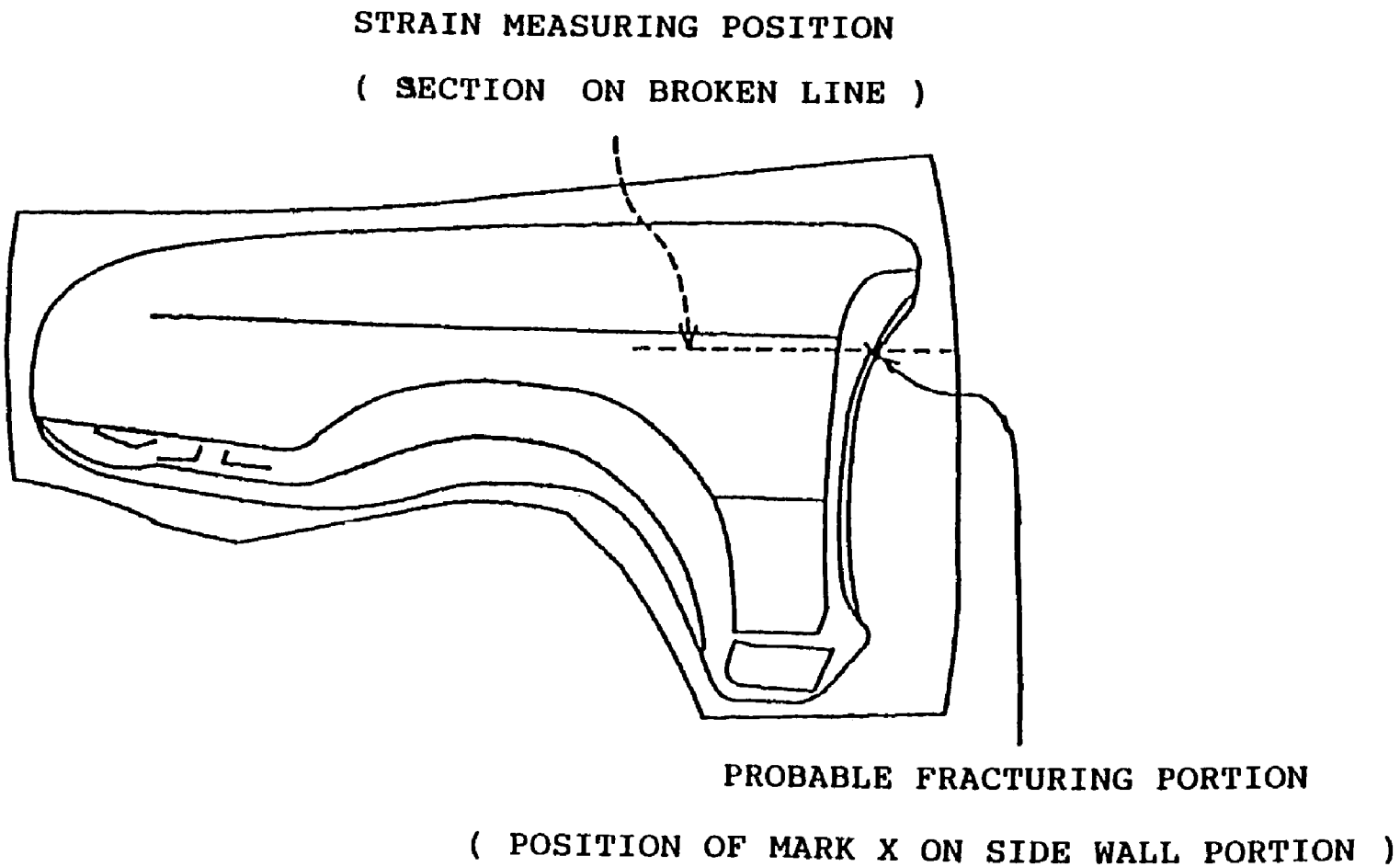
FIG. 14 illustrates a general view of an actual scale front fender model formed component, relating to the Embodiment 5.

FIG. 13 is a graph showing an example of equivalent strain distribution in the vicinity of probable-fracturing portion in an actual scale front fender model formed component. FIG. 14 illustrates a general view of the front fender model formed component. FIG. 13 shows that the probable-fracturing portion is at the side wall section, and the generated strain at the punch bottom section was 0.10 or less, though it increased to around 0.3 at the side wall section.

As a result, by increasing the strain propagation in a low strain region of the material, the amount of generated strain increases in a wide area of the material contacting with the punch bottom, thus improving the stretch forming performance. The plastic deformation theory shows that the strain propagation increases with the increase in the work hardening of material, (n value).

Accordingly, to increase the strain propagation in a low strain region of 10% or less, the n value for the deformation of 10% or less is needed to be increased. The n value determined by the two-point method, uniaxial tensile nominal strains 1% and 10%, is specified to 0.21 or more to significantly improve the stretch forming performance. To further improve the stretch forming performance, it is preferable that the n value of the two-point method, nominal strains 1% and 10%, is specified to 0.214. The uniaxial tensile test is done in accordance with JIS No.5 test.

Regarding the prevention of rough surface after the pressing, to attain better surface property according to the present invention, the condition equation, eq. (31), for the yield strength YP [MPa] and the ferritic grain average size d [μm], is preferably to change to eq. (31'), $$YP \leqq -60 \times d + 750 \quad (31')$$

Example 1

With the steels having chemical compositions listed in Table 10, the following-given tests were conducted. After melting to prepare the steels Nos. 1 through 10, continuous casting was applied to prepare respective slabs. Each of the slabs was heated to 1,200° C., then was hot-rolled to prepare a hot-rolled steel sheet having a thickness of 2.8 mm, under the conditions of finish temperatures of from 880 to 940° C., coiling temperatures of from 540 to 560° C. (for box annealing) or 600 to 660° C. (for continuous annealing, continuous annealing+hot dip galvanization), and was subjected to pickling and cold-rolling with draft percentages of from 50 to 85%.

After that, either one of the continuous annealing (annealing temperatures of from 800 to 860° C.), the box annealing (annealing temperatures of from 680 to 740° C.), and the continuous annealing+hot dip galvanization (annealing temperatures of from 800 to 860° C.) was applied. In the continuous annealing+hot dip galvanization, the hot dip galvanizing was given at 460° C. after the annealing, followed by immediately alloying treatment of the coating layer at 500° C. in an in-line alloying treatment furnace. For the steel sheet treated by annealing or annealing+hot dip galvanizing, temper rolling at draft percentage of 0.7% was applied.

The mechanical properties and the grain sizes of these steel sheets were determined. The specimens for the tensile test were those conforming to JIS No.5 tensile test, sampled in L-direction of the steel sheet. These steel sheets were applied to press-forming to obtain front fenders, with which the critical fracture cushion force was determined, and the generation of rough surface after the press-forming was also observed.

Furthermore, the transition temperature of secondary working brittleness was determined. A blank having 105 mm in diameter was punched from a steel sheet, which blank was treated by deep drawing (drawing ratio of 2.1) as the primary working, and cut at edge to make the cup height 35 mm. Then, the cup was immersed in a cooling medium such as ethyl alcohol each at a constant temperature, and a conical punch was applied to expand the cup edge portion as the secondary working, thus determined the temperature that the fracture mode of the cup transfers from the ductile fracture to the brittle fracture. The temperature is defined as the transition temperature of secondary working brittleness. The test results are shown in Table 11.

The symbols appeared in Table 11 specify the following.

N value: the value at 1 and 10% strains

CAL: Continuous annealing

BAF: Box annealing

CGL: Continuous annealing+hot dip galvanization

Example steel sheets Nos. 1 through 8 according to the present invention gave high critical fracture cushion force of 65 ton or more, and showed excellent stretch performance. To the contrary, the Comparative Example materials Nos. 9 through 12 had less n values in a low strain region, and generated fractures at a small cushion force of 45 ton or less. The Comparative Example materials Nos. 9 through 12 had coarse grain sizes, and showed rough surface after press-forming.

Examples Nos. 1 through 8 according to the present invention had fine grains and optimized structure of precipitate mode, thus showed excellent resistance to secondary working brittleness. The Example steels according to the present invention had favorable tailored blank performance and fatigue characteristics, adding to the superior formability. And, further the galvanized materials of the present invention was confirmed to have very good surface property. All the Example steels tested according to the present invention were proved to have extremely excellent total performance particularly for the exterior body sheets of automobiles.

Example 2

Figure 15:
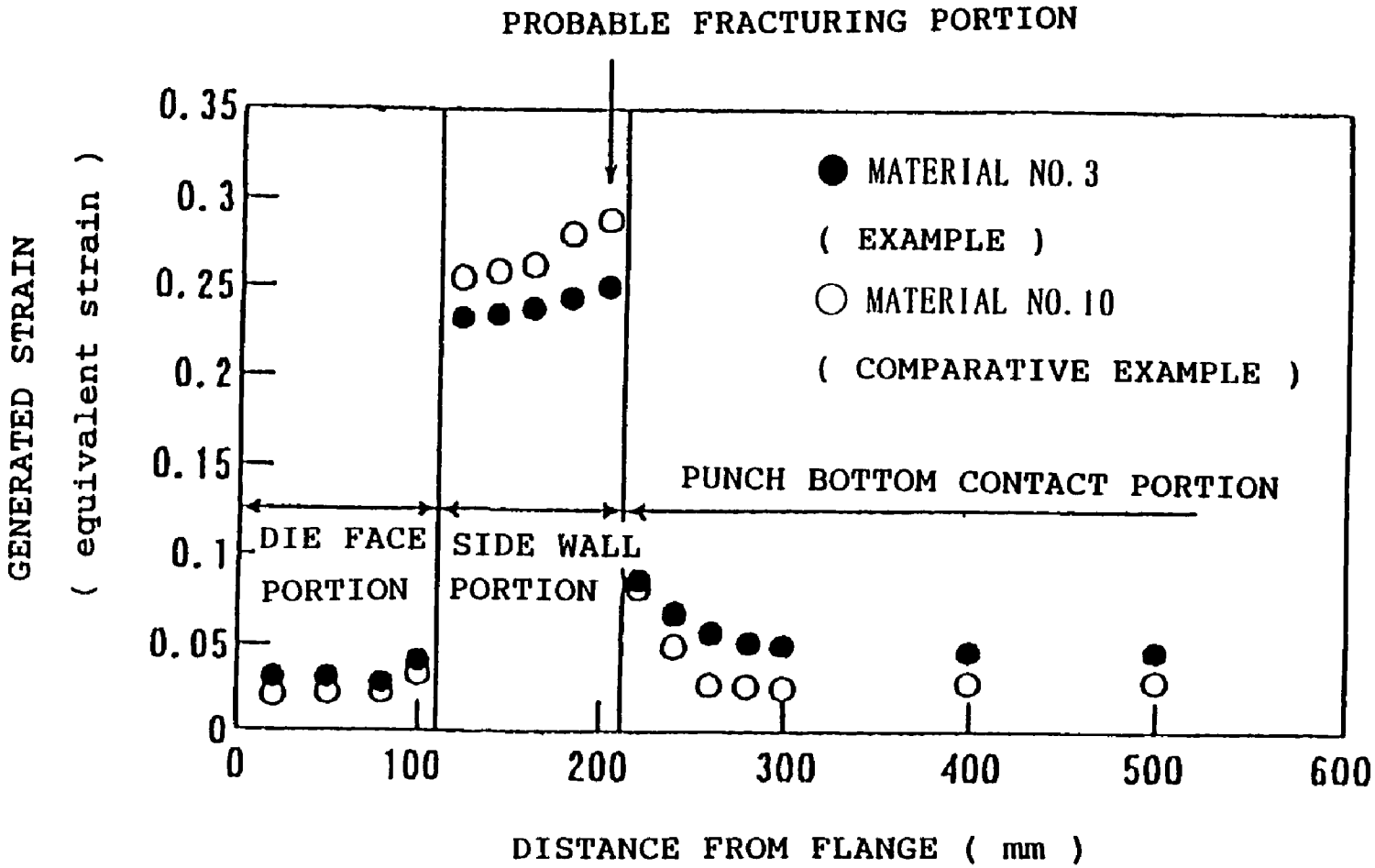
FIG. 15 is a graph showing an example of equivalent strain distribution in the vicinity of probable-fracturing section in an actual scale front fender model formed component, relating to the Embodiment 5.

FIG. 15 shows the results of model forming test given to the steel No. 3 (Example according to the present invention) and to the steel No. 10 (Comparative Example) listed in Table 11. The test was given to determine the strain distribution in the vicinity of probable-fracture section in the case of forming the front fender model shown in FIG. 14.

Compared with the Comparative Example (No. 10, ○ mark), the Example according to the present invention (No. 3, ● mark) gave large generated strain at the punch bottom portion, and the strain generation at the side wall section was suppressed. Thus, the steel sheets according to the present invention is concluded to be advantageous against fracture.

TABLE 10

| Steel No. | C | Si | Mn | P | S | sol.Al | N | Nb | Ti | B | Other | Remark |
|---|---|---|---|---|---|---|---|---|---|---|---|---|
| 1 | 0.0059 | 0.01 | 0.34 | 0.019 | 0.011 | 0.048 | 0.0018 | 0.078 | — | — | — | Example |
| 2 | 0.0065 | 0.01 | 0.35 | 0.021 | 0.012 | 0.067 | 0.0033 | 0.086 | — | — | — | Example |
| 3 | 0.0091 | 0.02 | 0.16 | 0.022 | 0.018 | 0.068 | 0.0028 | 0.128 | — | — | Cr: 0.35 | Example |
| 4 | 0.0063 | 0.02 | 0.66 | 0.041 | 0.009 | 0.045 | 0.0019 | 0.092 | 0.011 | 0.0004 | — | Example |
| 5 | 0.0069 | 0.13 | 0.64 | 0.025 | 0.011 | 0.057 | 0.0024 | 0.131 | 0.014 | — | Cu: 0.40, Ni: 0.30 | Example |
| 6 | 0.0058 | 0.25 | 0.62 | 0.043 | 0.010 | 0.065 | 0.0023 | 0.092 | — | 0.0008 | Mo: 0.25 | Example |
| 7 | 0.0025* | 0.26 | 0.35 | 0.022 | 0.009 | 0.055 | 0.0021 | 0.024 | 0.022 | 0.0011 | — | Comparative example |
| 8 | 0.0023* | 0.24 | 0.32 | 0.054 | 0.010 | 0.064 | 0.0028 | — | 0.082* | — | — | Comparative example |
| 9 | 0.0029* | 0.75* | 0.68 | 0.022 | 0.013 | 0.067 | 0.0019 | 0.058 | — | — | — | Comparative example |
| 10 | 0.0144* | 0.03 | 0.65 | 0.041 | 0.010 | 0.065 | 0.0021 | 0.149* | — | — | — | Comparative example |

TABLE 11

| | | | Characteristics of steel sheet | | | | | | Formability | Longitudinal crack transition | Resistance | |
|---|---|---|---|---|---|---|---|---|---|---|---|---|
| No. | Steel No. | Annealing condition | YP (MPa) | TS (MPa) | El (%) | n value* | r value | Grain size (μm) | Critical fracture cushion force (TON) | temperature (° C.) | to rough surface | Remark |
| 1 | 1 | CAL | 191 | 323 | 49 | 0.235 | 2.10 | 8.3 | 70 | −95° C. | ○ | Example |
| 2 | 2 | BAF | 204 | 345 | 47 | 0.229 | 2.15 | 8.1 | 75 | −85° C. | ○ | Example |
| 3 | 2 | CGL | 207 | 349 | 45 | 0.226 | 2.02 | 7.8 | 70 | −85° C. | ○ | Example |
| 4 | 2 | CAL | 203 | 346 | 46 | 0.227 | 2.04 | 7.7 | 75 | −95° C. | ○ | Example |
| 5 | 3 | CGL | 208 | 347 | 44 | 0.225 | 2.06 | 7.8 | 70 | −85° C. | ○ | Example |
| 6 | 4 | CAL | 222 | 374 | 42 | 0.223 | 1.92 | 7.5 | 65 | −90° C. | ○ | Example |
| 7 | 5 | CGL | 224 | 376 | 43 | 0.220 | 1.98 | 7.4 | 70 | −80° C. | ○ | Example |
| 8 | 6 | CAL | 234 | 393 | 40 | 0.219 | 1.93 | 7.1 | 65 | −85° C. | ○ | Example |
| 9 | 7 | BAF | 196 | 321 | 38 | 0.179 | 1.78 | 10.8 | 35 | −20° C. | x | Comparative example |
| 10 | 8 | CGL | 211 | 346 | 35 | 0.183 | 1.73 | 10.9 | 45 | −10° C. | x | Comparative example |
| 11 | 9 | CGL | 231 | 377 | 36 | 0.176 | 1.65 | 10.2 | 40 | −15° C. | x | Comparative example |
| 12 | 10 | CAL | 238 | 391 | 32 | 0.163 | 1.62 | 9.8 | 35 | −10° C. | x | Comparative example |

What is claimed is:

1. A steel sheet consisting essentially of 0.004 to 0.02% C, 1.0% or less Si, 0.7 to 3.0% Mn, 0.02 to 0.15% P, 0.02% or less S, 0.01 to 0.1% Al, 0.004% or less N, 0.2% or less Nb, by mass %, optionally Ti, Bi or at least one element selected from the group consisting of Cr, Mo, Ni and Cu, and the balance being Fe;

the Nb content satisfies a formula of $$(12/93)\times Nb^*/C \geqq 1.0,$$

wherein $Nb^*=Nb-(93/14)\times N$, and wherein C, N and Nb designate the content in mass % of carbon, nitrogen and niobium, respectively; and a yield strength and an average grain size of the ferritic grains which satisfy a formula of $$YP \leqq -120\times d+1280,$$

wherein YP designates yield strength in MPa, and d designates an average size of ferritic grains in μm.

2. The steel sheet of claim 1, wherein an n value of the steel sheet determined by 10% or lower deformation in a uniaxial tensile test satisfies a formula of $$n \text{ value} \geqq -0.00029\times TS+0.313$$

wherein TS designates tensile strength in MPa.

3. The steel sheet of claim 1, wherein the C content is from 0.005 to 0.008%.

4. The steel sheet of claim 1, wherein the Nb content is from 0.08 to 0.14%.

5. The steel sheet of claim 1, further containing 0.05% or less Ti.

6. The steel sheet of claim 1, further containing 0.002% or less B.

7. The steel sheet of claim 1, further containing 0.05% or less Ti and 0.002% or less B.

8. The steel sheet of claim 1, further containing at least one element selected from the group consisting of 1.0% or less Cr, 1.0% of less Mo, 1.0% or less Ni, and 1.0% or less Cu.

9. The steel sheet of claim 1, further comprising a zinc-based coating on the steel sheet.

10. A steel sheet consisting essentially of 0.004 to 0.02% C, 1.0% or less Si, 0.1 to 1.0% Mn, 0.01 to 0.07% P, 0.02% or less S, 0.01 to 0.1% Al, 0.004% or less N, 0.15% or less Nb, by mass %, optionally Ti, Bi or at least one element selected from the group consisting of Cr, Mo and Cu, and the balance being substantially Fe;

the Nb content satisfies a formula of $$(12/93)\times Nb^*/C \geqq 1.2$$

wherein $Nb^*=Nb-(93/14)\times N$, and wherein C, N, and Nb designate the content in mass % of carbon, nitrogen and niobium, respectively; and a yield strength and an average grain size of the ferritic grains which satisfy a formula of $$YP \leqq -60\times d+770,$$

wherein YP designates yield strength in MPa, and d designates an average size of ferritic grains in μm.

11. The steel sheet of claim 10, wherein the C content is from 0.005 to 0.008%.

12. The steel sheet of claim 10, wherein the Nb content is from 0.08 to 0.14%.

13. The steel sheet of claim 10, wherein an n value of the steel sheet determined by 10% or lower deformation in a uniaxial tensile test is 0.21 or more.

14. The steel sheet of claim 10, further containing 0.05% or less Ti.

15. The steel sheet of claim 10, further containing 0.002% or less B.

16. The steel sheet of claim 10, further containing 0.05% or less Ti and 0.002% or less B.

17. The steel sheet of claim 10, further containing at least one element selected from the group consisting of 1.0% or less Cr, 1.0% of less Mo, 1.0% or less Ni, 1.0% or less Cu.

18. The steel sheet of claim 10, further comprising a zinc-base coating on the steel sheet.

* * * * *